US010550545B2

(12) United States Patent
Oshikawa et al.

(10) Patent No.: US 10,550,545 B2
(45) Date of Patent: Feb. 4, 2020

(54) WORK VEHICLE

(71) Applicant: KOMATSU LTD., Tokyo (JP)

(72) Inventors: Yuushi Oshikawa, Komatsu (JP); Takashi Noda, Hirakata (JP); Taira Ozaki, Ikoma (JP); Takuya Uemura, Hirakata (JP); Hiroshi Itogawa, Kanazawa (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/526,842

(22) PCT Filed: Feb. 23, 2015

(86) PCT No.: PCT/JP2015/055084
§ 371 (c)(1),
(2) Date: May 15, 2017

(87) PCT Pub. No.: WO2016/092868
PCT Pub. Date: Jun. 16, 2016

(65) Prior Publication Data

US 2017/0321392 A1 Nov. 9, 2017

(30) Foreign Application Priority Data

Dec. 12, 2014 (JP) ..... 2014-252484
Dec. 12, 2014 (JP) ..... 2014-252485

(51) Int. Cl.
*E02F 9/00* (2006.01)
*E02F 9/08* (2006.01)
(Continued)

(52) U.S. Cl.
CPC ..... *E02F 9/0866* (2013.01); *E02F 9/16* (2013.01); *E02F 9/2004* (2013.01)

(58) Field of Classification Search
CPC . E02F 9/163; E02F 9/0866; E02F 9/16; E02F 9/2004; E02F 9/0891
See application file for complete search history.

(56) References Cited

U.S. PATENT DOCUMENTS 1,333,418 A 3/1920 Holmes
3,319,732 A 5/1967 Soeteber et al.
(Continued)

FOREIGN PATENT DOCUMENTS

JP 11-280112 A 10/1999
JP 11-310938 A 11/1999
(Continued)

OTHER PUBLICATIONS

The International Search Report for the corresponding international application No. PCT/JP2015/084425, dated Mar. 1, 2016.
(Continued)

*Primary Examiner* — Hau V Phan
(74) *Attorney, Agent, or Firm* — Global IP Counselors, LLP

(57) ABSTRACT

A work vehicle includes a vehicle body, a travel device, a driving source, and a cooling device. The travel device is provided below the vehicle body. The driving source is disposed in a front part of the vehicle body. The driving source generates driving power for the travel device. The cooling device is disposed on one side in the vehicle width direction of the vehicle body and rearward of the driving source.

15 Claims, 14 Drawing Sheets

(51) Int. Cl.
*E02F 9/16* (2006.01)
*E02F 9/20* (2006.01)

(56) References Cited

U.S. PATENT DOCUMENTS

| | | | | |
|---|---|---|---|---|
| 4,081,050 | A | 3/1978 | Hennessey et al. | |
| 4,567,956 | A | 2/1986 | Matsuda et al. | |
| 5,036,931 | A | 8/1991 | Iritani | |
| 5,209,314 | A | 5/1993 | Nishiyama | |
| 5,660,244 | A | 8/1997 | Matsuda | |
| 5,678,648 | A | 10/1997 | Imanishi et al. | |
| 5,887,671 | A | 3/1999 | Yuki et al. | |
| 7,143,852 | B2 | 12/2006 | Yatsuda et al. | |
| 7,717,218 | B2 * | 5/2010 | Matsumoto | E02F 9/163 180/291 |
| 7,753,152 | B2 | 7/2010 | Nakae et al. | |
| 8,205,701 | B2 | 6/2012 | Kuramoto et al. | |
| 8,505,661 | B2 | 8/2013 | Tsuji et al. | |
| 8,657,048 | B2 * | 2/2014 | Uetake | E02F 9/0891 180/68.1 |
| 8,789,637 | B1 | 7/2014 | Kinoshita et al. | |
| 8,905,180 | B2 | 12/2014 | Sakurahara et al. | |
| 8,936,122 | B2 | 1/2015 | MacGregor et al. | |
| 8,960,342 | B2 * | 2/2015 | Werner | B60K 11/04 165/41 |
| 9,061,582 | B2 * | 6/2015 | Sawada | B60K 13/04 |
| 9,315,097 | B2 | 4/2016 | Ducroquet et al. | |
| 9,327,582 | B2 * | 5/2016 | Matsumiya | E02F 9/0891 |
| 9,376,786 | B2 | 6/2016 | Numasawa | |
| 9,388,730 | B2 | 7/2016 | Tsutsumi et al. | |
| 2002/0053480 | A1 * | 5/2002 | Pack | B60K 11/04 180/374 |
| 2003/0168269 | A1 * | 9/2003 | Pfusterschmid | B60K 11/04 180/68.4 |
| 2005/0077062 | A1 * | 4/2005 | Fukazawa | B60K 11/04 172/776 |
| 2008/0023174 | A1 * | 1/2008 | Nakae | B60K 11/04 165/42 |
| 2010/0236855 | A1 * | 9/2010 | Matsushita | B62D 25/10 180/69.2 |
| 2012/0325569 | A1 | 12/2012 | Takeda et al. | |
| 2014/0196974 | A1 * | 7/2014 | Hayashi | B60K 13/04 180/309 |
| 2015/0176451 | A1 | 6/2015 | Tsutsumi et al. | |

FOREIGN PATENT DOCUMENTS

| | | | |
|---|---|---|---|
| JP | 2002-154340 | A | 5/2002 |
| JP | 2004-306911 | A | 11/2004 |
| JP | 2005-48504 | A | 2/2005 |
| JP | 2007-100351 | A | 4/2007 |
| JP | 2009-507145 | A | 2/2009 |
| JP | 2009-113744 | A | 5/2009 |
| JP | 2013-204295 | A | 10/2013 |
| JP | 2013-248964 | A | 12/2013 |
| JP | 2014-84832 | A | 5/2014 |
| JP | 2014-141857 | A | 8/2014 |
| WO | 2010/001629 | A1 | 1/2010 |
| WO | 2012/086519 | A1 | 6/2012 |

OTHER PUBLICATIONS

The Written Opinion for the corresponding international application No. PCT/JP2015/084425, dated Mar. 1, 2016.
The International Search Report for the corresponding international application No. PCT/JP2015/055084, dated May 19, 2015.
The Final Office Action for the related U.S. Appl. No. 15/553,325 dated Aug. 13, 2018.

* cited by examiner

WORK VEHICLE

CROSS-REFERENCE TO RELATED APPLICATIONS

This application is a U.S. National stage application of International Application No. PCT/JP2015/055084, filed on Feb. 23, 2015. This U.S. National stage application claims priority under 35 U.S.C. § 119(a) to Japanese Patent Application No. 2014-252484, filed in Japan on Dec. 12, 2014, and Japanese Patent Application No. 2014-252485, filed in Japan on Dec. 12, 2014 the entire contents of which are hereby incorporated herein by reference.

BACKGROUND

Field of the Invention

The present invention relates to a work vehicle.

Description of the Related Art

For example, a bulldozer in Japanese Laid-open Patent 2013-204295 has a cooling device disposed at the front end of the vehicle body.

However, when the cooling device is disposed at this position, there is a possibility that earth and sand may enter the cooling device through the front during work and reduce the performance of the cooling device.

SUMMARY

An object of the present invention is to provide a technique that can prevent a reduction in performance of a cooling device.

A work vehicle according to a first exemplary embodiment of the present invention is provided with a vehicle body, a travel device, a driving source, and a cooling device. The travel device is provided below the vehicle body. The driving source is disposed in a front part of the vehicle body. The driving source generates driving power for the travel device. The cooling device is disposed rearward of the driving source and on one side in the vehicle width direction of the vehicle body.

The vehicle body may also have a work area positioned facing the cooling device rearward of the driving source.

The work vehicle may be further provided with a device to be maintained that requires maintenance and is disposed between the driving source and the work area.

The work vehicle may be further provided with a fuel tank that is disposed in a rear part of the vehicle body and that extends in the vehicle width direction with respect to the center of the vehicle width direction of the vehicle body.

The work vehicle may be further provided with a power transmission mechanism and a first partition plate. The power transmission mechanism may transmit the driving power generated by the driving source to the travel device. The power transmission mechanism may be positioned below the work area. The first partition plate may separate the work area and the power transmission mechanism. The first partition plate may have a first inspection port that allows communication from the work area to the power transmission mechanism.

The work vehicle may be further provided with a first cover member that covers the cooling device. The first cover member may have a second inspection port between the work area and the cooling device.

The work vehicle may be further provided with a second cover member that covers the driving source. The second cover member may have a third inspection port between the work area and the driving source. The second cover member may have a third inspection port between the work area and the device to be maintained.

The work area may be surrounded by the cooling device, the device to be maintained, and the fuel tank.

The travel device may have a crawler belt. The cooling device may overlap the crawler belt as seen from above.

A work vehicle according to a second exemplary embodiment of the present invention is provided with a vehicle body, a travel device, a driving source, a work area, and a cover member. The travel device is provided below the vehicle body. The driving source generates driving power for the travel device. The driving source is disposed in a front part of the vehicle body. The work area is provided rearward of the driving source. The cover member covers the driving source. The cover member has a third inspection port that allows communication from the work area to the driving source.

The work vehicle may be further provided with a cooling device disposed to the lateral side of the work area and on one side in the vehicle width direction of the vehicle body.

The work vehicle may be further provided with a power transmission mechanism and a first partition plate. The power transmission mechanism may transmit the driving power generated by the driving source to the travel device. The power transmission mechanism may be positioned below the work area. The first partition plate may separate the work area and the power transmission mechanism. The first partition plate may have a first inspection port that allows communication from the work area to the power transmission mechanism.

The cooling device is disposed on one side in the vehicle width direction of the vehicle body and rearward of the driving source disposed in the front part of the vehicle body in the work vehicle according to the present invention. Therefore, earth and sand do not enter the cooling device from the front during work. Consequently, the work vehicle is able to prevent a reduction in performance of the cooling device.

DESCRIPTION OF EXEMPLARY EMBODIMENTS

First Exemplary Embodiment

Figure 1:
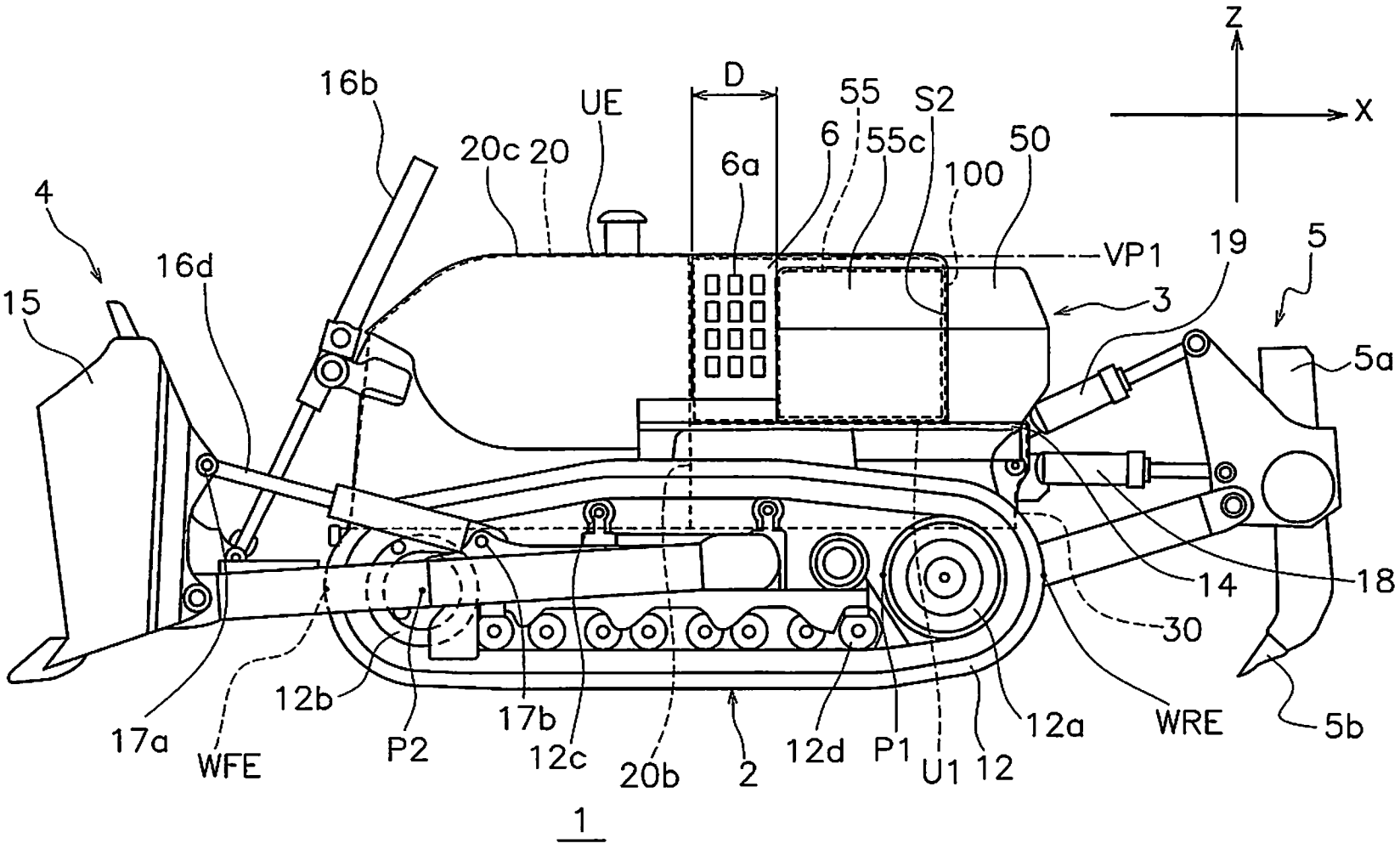
FIG. 1 is a side view of a work vehicle according to a first exemplary embodiment.
Figure 2:
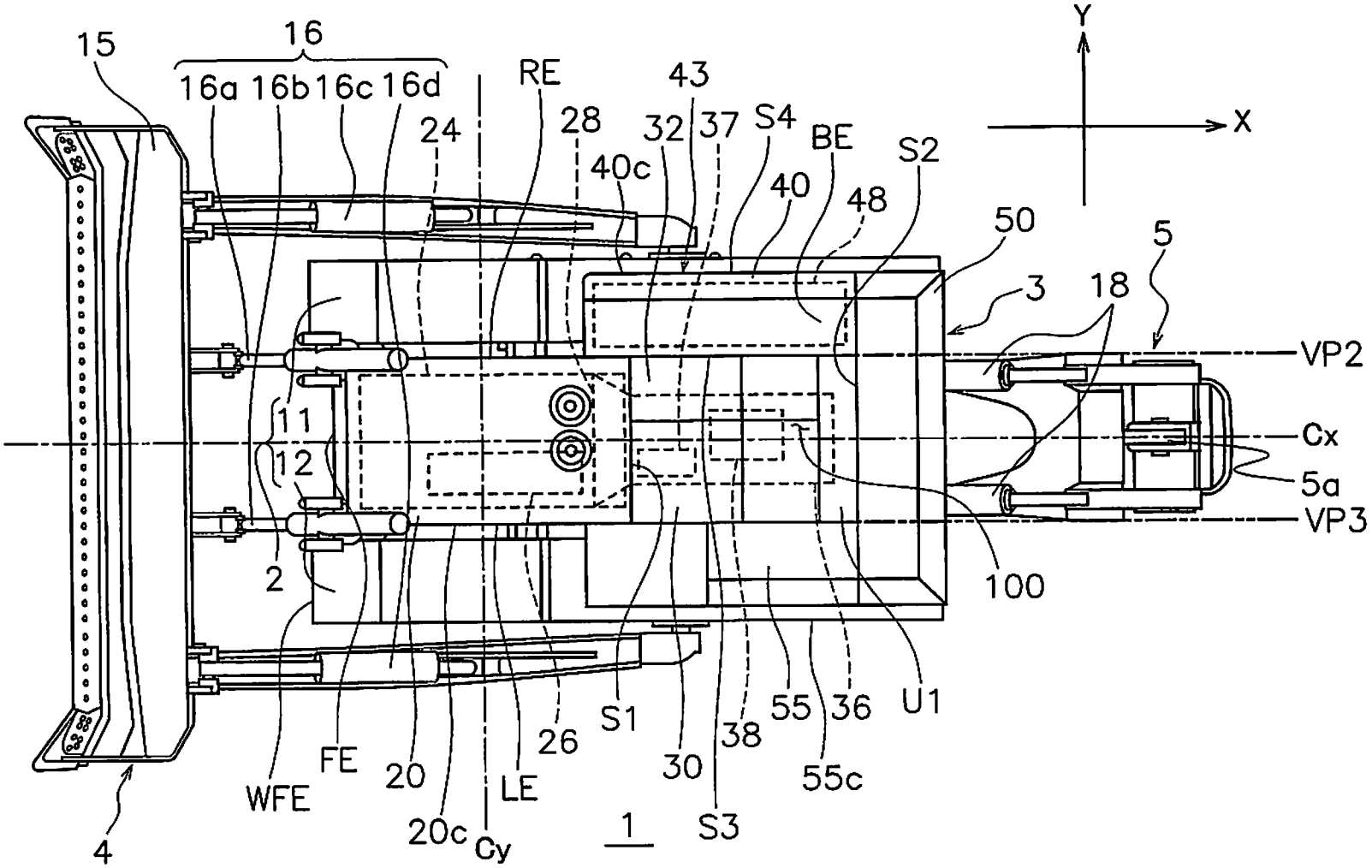
FIG. 2 is a top view of the work vehicle according to the first exemplary embodiment.

Exemplary embodiments of the present invention will be explained in detail with reference to the figures. FIG. 1 is a side view of a work vehicle 1 according to the first exemplary embodiment of the present invention. FIG. 2 is a top view of the work vehicle 1 while a below-mentioned cover 6 is removed. As illustrated in FIG. 1, the work vehicle 1 has a travel device 2, a vehicle body 3, a first work implement 4, a second work implement 5, and the cover 6. The work vehicle 1 according to the present exemplary embodiment is a vehicle without an operator cab, or more specifically, a bulldozer without an operator cab.

The travel device 2 is a device for causing the work vehicle 1 to travel. The work vehicle 1 is able to carry out work, such as excavation and leveling, by using the first work implement 4 and the second work implement 5. In the present exemplary embodiment, the first work implement 4 is a blade, for example. The second work implement 5 is a ripper, for example. As illustrated in FIG. 2, the travel device 2 has a first crawler belt 11 and a second crawler belt 12. The work vehicle 1 travels due to the first crawler belt 11 and the second crawler belt 12 being driven. The work vehicle 1 turns by changing the drive speed of the first crawler belt 11 and the drive speed of the second crawler belt 12. The vehicle body 3 is provided rearward of the first work implement 4. The travel device 2 is provided below the vehicle body 3.

In the following explanation, the vehicle width direction is the arrangement direction of the pair of the travel devices 2 disposed side by side. The forward direction is perpendicular to the vehicle width direction and is the direction from the center of the vehicle body 3 toward the position where a below-mentioned engine 24 is disposed. The rearward direction is the direction opposite the forward direction. Left and right refer to the left and right directions while facing in the forward direction. The left and right directions may be paraphrased as the vehicle width direction. Up and down refer to the up and down directions while facing in the forward direction.

In the drawings of the exemplary embodiments, the X-axis positive, direction (+X direction), the X-axis negative direction (−X direction), and the X-axis direction respectively indicate the orientations referred to as the rearward direction, the forward direction, and the front-back direction (or "longitudinal direction"), respectively, of the work vehicle. The Y-axis positive direction (+Y direction), the Y-axis negative direction (−Y direction), and the Y-axis direction respectively indicate the orientations referred to as the right direction, the left direction, and the left-right direction (vehicle width direction or "lateral direction") of the work vehicle. The Z-axis positive direction (+Z direction), the Z-axis negative direction (−Z direction), and the Z-axis direction respectively indicate the orientations referred to as the upward direction, the downward direction, and the vertical direction of the work vehicle.

When referring to FIG. 2, the work vehicle 1 is provided with the engine 24, an exhaust processing device 26, and an after-cooler 28. The engine 24 is, for example, a diesel engine. The engine 24 is a driving source for generating driving power for driving the travel device 2, the first work implement 4, and the second work implement 5. The driving power generated by the engine 24 is distributed by a power take-off (PTO) (not illustrated) to a hydraulic pump for driving the first work implement 4 and the second work implement 5, and to a below-mentioned power transmission mechanism 36. The exhaust processing device 26 purifies the exhaust of the engine 24. The after-cooler 28 is the after-cooler of the engine 24. The exhaust processing device 26 and the after-cooler 28 are disposed higher than the engine 24.

The work vehicle 1 is provided with an engine compartment 20 covered by a first cladding member 20*c*. The engine compartment 20 contains the engine 24, the exhaust processing device 26, and the after-cooler 28. The first cladding member 20*c* covers the engine 24, the exhaust processing device 26, and the after-cooler 28. The engine compartment 20 is positioned on the front side of the vehicle body 3 and defines a front part of the vehicle body 3. The engine 24, the exhaust processing device 26, and the after-cooler 28 are disposed in the front part of the vehicle body 3. The upper surface of the first cladding member 20*c* is raised so as to be separated from a below-mentioned first cylinder 16*a* and a second cylinder 16*b*, and the upper end part of the first cladding member 20*c* forms a horizontal plane. The upper end part is referred to as an upper end part UE. The first cladding member 20*c* may also be referred to as a second cover member.

The after-cooler 28 is disposed on the rear side of the center Cy in the front-back direction of the engine compartment 20. The after-cooler 28 is a device that requires maintenance by a worker. The after-cooler 28 may also be referred to as a device to be maintained.

The work vehicle 1 is provided with the power transmission mechanism 36, a hydraulic pump 37, and a control valve 38. The power transmission mechanism 36 is connected to the engine 24 and transmits the driving power generated by the engine 24 to the travel device 2. The power transmission mechanism 36 includes a transmission, a torque converter, and a steering mechanism, for example. The hydraulic pump 37 is driven by driving power from the engine 24. Hydraulic fluid discharged by the hydraulic pump 37 is supplied to various types of members (for example, transmission clutches and steering mechanism clutches and brakes) of the power transmission mechanism 36 via the control valve 38. The control valve 38 controls the hydraulic pressure supplied to the afore-mentioned various members of the power transmission mechanism 36. The control valve 38 is controlled with electrical signals.

As illustrated in FIG. 1, the work vehicle 1 is provided with a power transmission mechanism compartment 30 below a first partition plate U1. The power transmission mechanism compartment 30 is an area that abuts a lower part 20*b* of the engine compartment 20 and that is surrounded by a vehicle body frame (not illustrated) and the first partition plate U1. The power transmission mechanism compartment 30 contains the power transmission mechanism 36, the hydraulic pump 37, and the control valve 38.

The work vehicle 1 is further provided with a first cooling device 48. The first cooling device 48 includes a radiator that cools a coolant for cooling the engine 24, for example, and may further include an oil cooler that cools the hydraulic fluid. The first cooling device 48 is disposed rearward of the engine 24 and on one side in the vehicle width direction of the vehicle body 3. The first cooling device 48 is positioned on the right side of the center Cx in the vehicle width direction of the vehicle body 3. The first cooling device 48 extends rearward on the rear side of the engine 24 as seen from above.

As illustrated in FIG. 2, the work vehicle 1 is provided with a second cladding member 40*c* that covers the first cooling device 48. The area enclosed by the second cladding member 40*c* is referred to as a cooling device compartment 40. The cooling device compartment 40 has a substantially square column shape. The cooling device compartment 40 is adjacent to the engine compartment 20. The cooling device compartment 40 is disposed to the outside of the engine compartment 20 in the vehicle width direction. The cooling device compartment 40 is disposed on one side in the vehicle width direction of the vehicle body 3. The cooling device compartment 40 is positioned to the right of a right end RE of the engine compartment 20. The cooling device compartment 40 extends to the rear on the rear side of a first side surface S1 that corresponds with the rear end of the engine compartment 20. The second cladding member 40*c* may also be referred to as a first cover member.

The work vehicle 1 is provided with a fuel tank 50 rearward of the first cooling device 48. The fuel tank 50 has a square column shape with a side surface inclined upward and rearward. The fuel tank 50 abuts a rear end part BE of the cooling device compartment 40 and extends in the left direction. The fuel tank 50 is spaced away from the engine compartment 20. The fuel tank 50 is disposed in the end part (rear part) of the rear side of the vehicle body 3. The fuel tank 50 extends in the vehicle width direction relative to the center Cx of the vehicle body 3 in the vehicle width direction. When referring to FIG. 1, the fuel tank 50 is disposed above the power transmission mechanism compartment 30.

The plane that passes through the upper end part UE of the engine compartment 20 and extends rearward and in the horizontal direction is defined as a first virtual plane VP1. In FIG. 2, the plane that passes through the right end RE of the engine compartment 20 and extends rearward and in the vertical direction is defined as a second virtual plane VP2. The plane that passes through a left end LE of the engine compartment 20 and extends rearward and in the vertical direction is defined as a third virtual plane VP3. The side surface of the fuel tank 50 on the forward side is a second side surface S2. The first virtual plane VP1, the second virtual plane VP2, and the third virtual plane VP3 are depicted as chain double-dashed lines in FIGS. 1 and 2.

A space 100 enclosed by the first virtual plane VP1, the second virtual plane VP2, the third virtual plane VP3, the first side surface S1, the second side surface S2, and the first partition plate U1 is hollow. The space 100 is referred to as a work area. The vehicle body 3 has the work area 100 in a position facing the first cooling device 48 rearward of the engine 24. The work area 100 is surrounded by the power transmission mechanism compartment 30, the cooling device compartment 40, the fuel tank 50, and a belowmentioned first additional storage compartment 55. The work area 100 is surrounded by the first cooling device 48, the after-cooler 28, and the fuel tank 50.

The work vehicle 1 further includes a hydraulic fluid tank (not illustrated) and a reducing agent tank (not illustrated) used by the exhaust processing device 26. The hydraulic fluid tank and the reducing agent tank are covered by a third cladding member 55*c*. The area enclosed by the third cladding member 55*c* is referred to as the first additional storage compartment 55. The first additional storage compartment 55 has a substantially square column shape.

The first additional storage compartment 55 is adjacent to the fuel tank 50. The first additional storage compartment 55 extends rearward from behind the rear end S1 of the engine compartment 20. The first additional storage compartment 55 is positioned on the left side of the engine compartment 20. The first additional storage compartment 55 is positioned on the left side of the center Cx in the vehicle width direction of the vehicle body 3. The first additional storage compartment 55 is disposed on the other side of the opposite side the one side where the cooling device compartment 40 is disposed. The first additional storage compartment 55 is disposed so as to be spaced away from the cooling device compartment 40.

When referring to FIG. 1, the first additional storage compartment 55 is disposed above the power transmission mechanism compartment 30. A gap having a distance D in the horizontal direction is provided between the first additional storage compartment 55 and the engine compartment 20. The distance D has, for example, a length of 450 mm or greater which is the passageway width for lateral walking on an earth-moving machinery, as prescribed in ISO 2867. As a result, a worker is able to pass through the gap and enter the work area 100. The cover 6 is formed so as to cover the work area 100 and block the gap. The upper surface of the cover 6 is formed along the upper end part UE of the engine compartment 20. Ventilation holes 6*a* are provided in the portion of the cover 6 that blocks the gap. The cover 6 is removed when a worker carries out maintenance work.

In the present exemplary embodiment, the first additional storage compartment 55 is depicted as being adjacent to the fuel tank 50. However, the first additional storage compartment 55 may be provided adjacent to the engine compartment 20 and the gap having the distance D in the horizontal direction may be provided between the first additional storage compartment 55 and the fuel tank 50. In this case as well, the cover 6 may cover the gap between the first additional storage compartment 55 and the fuel tank 50.

Figure 3:
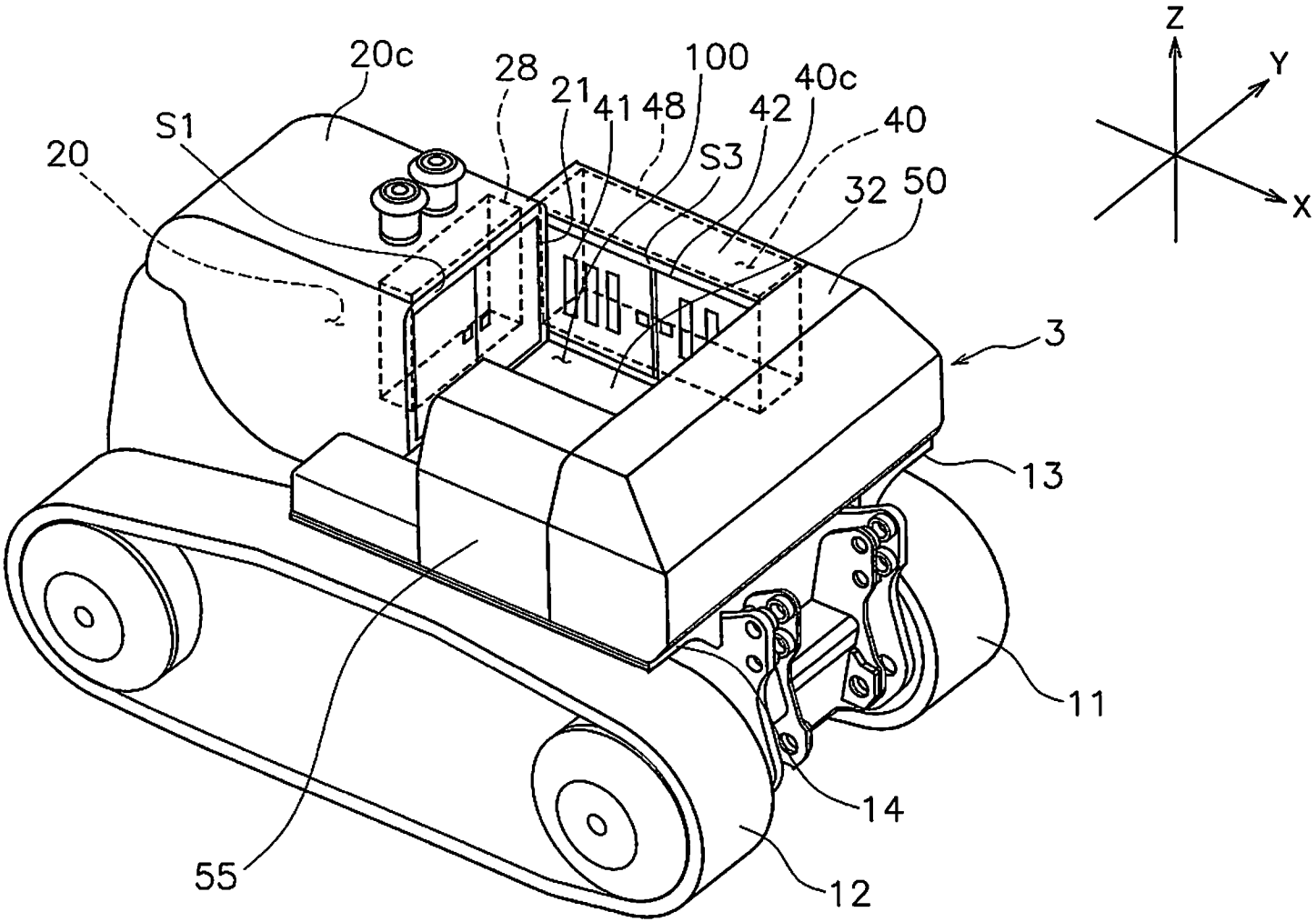
FIG. 3 is a perspective view of the work vehicle according to the first exemplary embodiment.

FIG. 3 is a perspective view of a work vehicle 1 according to the first exemplary embodiment. The work vehicle 1 is depicted with the first work implement 4, the second work implement 5, and the cover 6 removed in FIG. 3. The second crawler belt 12 is depicted schematically. When referring to FIG. 3, the first cladding member 20*c* of the engine compartment 20 includes a third inspection port 21 that can be opened and closed on the first side surface S1. The third inspection port 21 is disposed between the work area 100 and the engine 24 and allows communication from the work area 100 to the engine 24.

The after-cooler 28 is positioned on the reverse side of the third inspection port 21. The after-cooler 28 is disposed between the engine 24 and the work area 100. A worker is able to easily perform maintenance on the after-cooler 28 by entering the work area 100 and opening the third inspection port 21.

The cooling device compartment 40 is disposed above the power transmission mechanism compartment 30. The second cladding member 40*c* of the cooling device compartment 40 includes a second inspection port 42 that can be opened and closed on a third side surface S3. The third side surface S3 is the left side surface (side surface facing the center Cx in the vehicle width direction of the vehicle body 3) of the cooling device compartment 40. The third side surface S3 is on the right side (the one side in the vehicle width direction of the vehicle body 3 discussed above) of the first side surface S1. The first cooling device 48 is positioned on the reverse side of the second inspection port 42. The second inspection port 42 is positioned between the first cooling device 48 and the work area 100. A worker is able to easily perform maintenance on the first cooling device 48 by entering the work area 100 and opening the second inspection port 42.

Ventilation holes 41 are also provided on the third side surface S3. Ventilation holes 43 are provided on a fourth side surface S4 (see FIG. 2) which is the right side surface (side surface of opposite side in left-right direction from the third side surface S3) of the cooling device compartment 40. Consequently, a flow path for outside air is formed from the ventilation holes 6*a* of the cover 6 to the work area 100, the third side surface S3, the first cooling device 48, and the fourth side surface S4 in this order. Alternatively, a flow path is formed in the reverse order thereof. Because the outside air can more easily pass through the flow path, the cooling performance of the first cooling device 48 is improved in comparison to the cooling device of a conventional work vehicle.

When referring to FIG. 1, the first partition plate U1 separates the work area 100 and the power transmission mechanism compartment 30. When referring to FIG. 2 and FIG. 3, the first partition plate U1 includes a hatch 32 that can be opened and closed. The hatch 32 may be referred to as a first inspection port. The power transmission mechanism 36 is disposed below the hatch 32 (that is, below the work area 100), and the hatch 32 allows communication from the work area 100 to the power transmission mechanism 36.

Figure 4:
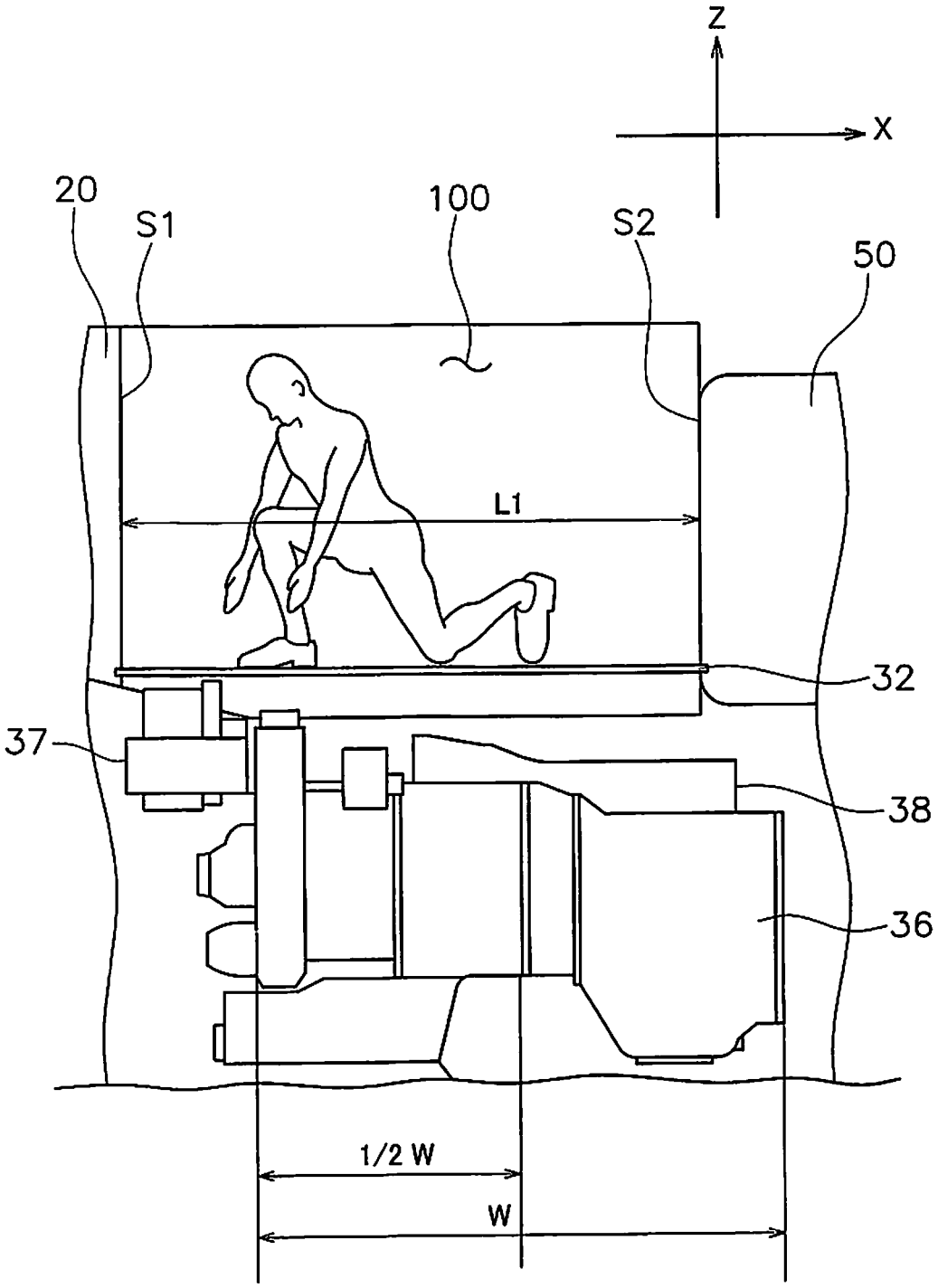
FIG. 4 is a periphery view of a hatch of the work vehicle according to the first exemplary embodiment.

FIG. 4 is a view of the vicinity of the hatch 32 of the work vehicle 1 according to the first exemplary embodiment. As can be seen, the work area 100 is provided from the first side surface S1 to the second side surface S2 in the work vehicle 1. A first distance L1 that is the distance in the front-back direction between the first side surface S1 and the second side surface S2 is greater than one half (½ W) of a length W in the front-back direction of the power transmission mechanism 36. The first distance L1 is 1.5 m or greater and is a value close to the length W in the front-back direction of the power transmission mechanism 36.

Figure 5:
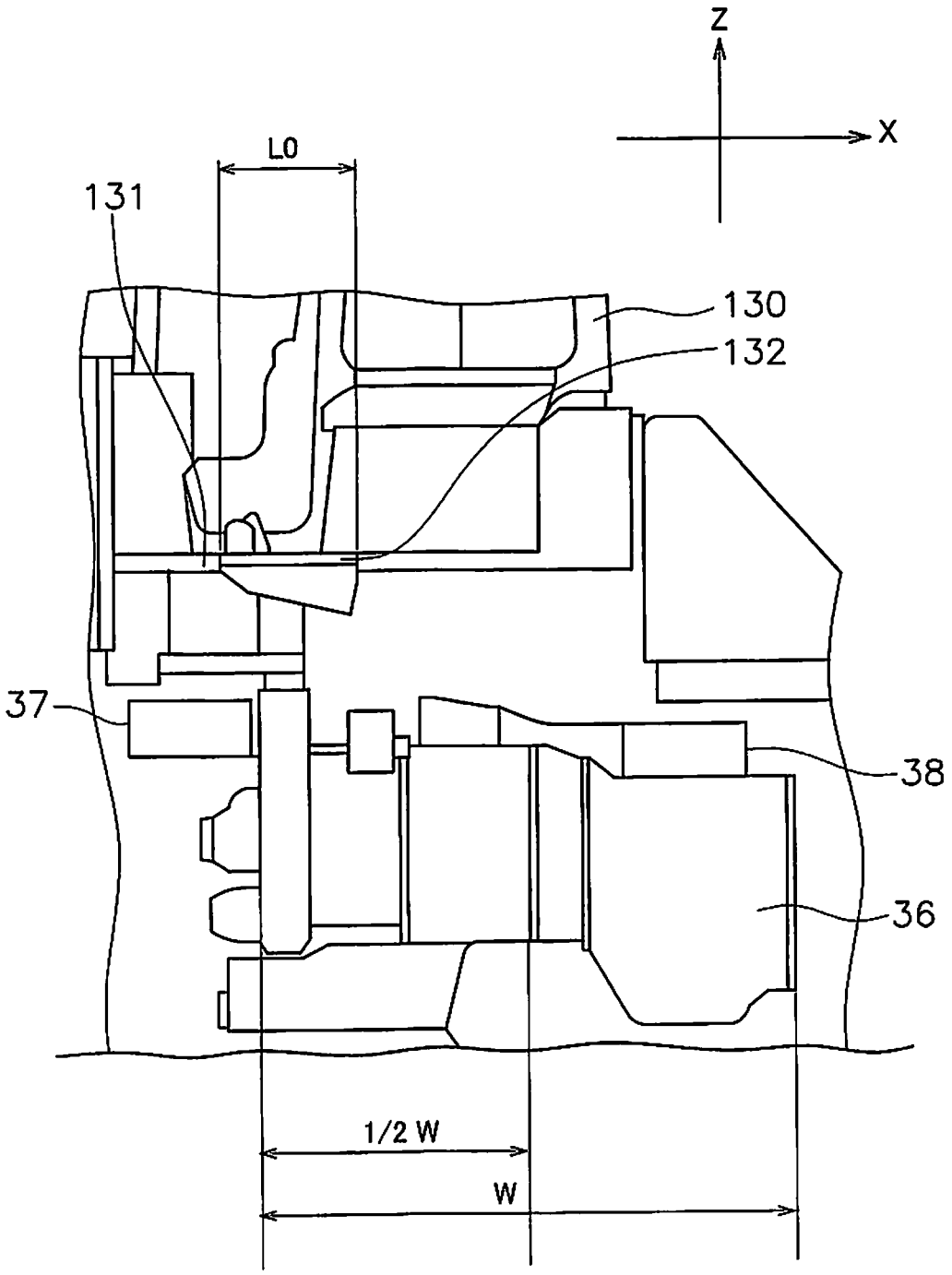
FIG. 5 is a periphery view of a hatch of a work vehicle with a cab.

Conversely, FIG. 5 illustrates the vicinity of a hatch in a work vehicle having a conventional cab as a comparative example. As depicted in FIG. 5, a hatch 132 is provided in a floor surface 131 of a cab 130 in the conventional work vehicle. The width L0 in the front-back direction of the hatch 132 is small. The width L0 in the front-back direction of the hatch 132 is shorter than one half (½ W) of the length W in the front-back direction of the power transmission mechanism 36. As a result, access to the power transmission mechanism 36 and the devices (especially the control valve 38) accompanied by the power transmission mechanism 36 from the hatch 132 is extremely difficult.

The worker is able to easily access the power transmission mechanism 36 or the hydraulic pump 37 and the control valve 38 attached to the power transmission mechanism 36 by opening the hatch 32. The worker enters the work area 100 and is able to easily perform maintenance on the power transmission mechanism 36 or the devices accompanied by the power transmission mechanism 36.

When referring to FIG. 3, the vehicle body 3 further includes a first fender 13 and a second fender 14. The first fender 13 is provided directly above the first crawler belt 11. The second fender 14 is provided directly above the second crawler belt 12. The cooling device compartment 40 is disposed directly above the first fender 13. As illustrated in FIG. 2, the cooling device compartment 40 overlaps the first crawler belt 11 as seen from above. The first cooling device 48 overlaps the first crawler belt 11.

The first additional storage compartment 55 is disposed directly above the second fender 14. Therefore as illustrated in FIG. 2, the first additional storage compartment 55 overlaps the second crawler belt 12 as seen from above. The first crawler belt 11 is provided on the right side of the vehicle body 3 and extends in the front-back direction. The second crawler belt 12 is provided on the left side of the vehicle body 3 and extends in the front-back direction.

When referring to FIG. 3, the fuel tank 50 extends from the first fender 13 to the second fender 14. The fuel tank 50 is disposed so as to cross from the one end to the other end in the vehicle width direction of the vehicle body 3. The fuel tank 50 is positioned in the end part (rear part) of the rear side of the vehicle body 3. The vehicle body frame is provided at the end of the vehicle body 3. The fuel tank 50 is supported by the first fender 13, the second fender 14, and the vehicle body frame. Therefore, even when the fuel tank 50 is heavy, the fuel tank 50 can be supported in a stable manner.

When referring to FIG. 1, the second crawler belt 12 includes a second drive wheel (sprocket) 12*a*, a second driven wheel (idler) 12*b*, a plurality of second carrier rollers 12*c*, and a plurality of track rollers 12*d*. The above members are rotating members that rotate when the second crawler belt 12 moves. Among the above members, the second driven wheel 12*b* is the rotating member closest to a front end part WFE which is the end part on the front side of the travel device 2 (second crawler belt 12). The second drive wheel 12*a* is the rotating member closest to a rear end part WRE of the travel device 2 (second crawler belt 12). In FIG. 2, the first crawler belt 11 and the second crawler belt 12 are symmetrical with respect to the center axis Cx of the vehicle width direction of the vehicle body 3, and therefore the first crawler belt 11 and the second crawler belt 12 have the same structure.

When referring to FIG. 1, the second side surface S2 of the fuel tank 50 is positioned on the rear side of a front end point P1 of the second drive wheel 12*a*. Because the first crawler belt 11 and the second crawler belt 12 have the same structure, the second side surface S2 of the fuel tank 50 can also be positioned on the rear side of the front end point of the drive wheel of the first crawler belt 11. The driven wheel may be the rotating member closest to the rear end part WRE due to the structures of the first crawler belt 11 and the second crawler belt 12. In this case, the second side surface S2 of the fuel tank 50 is positioned on the rear side of the front end point of the driven wheel which is the rotating member closest to the rear end part WRE.

When referring to FIG. 2, the first work implement 4 is provided in front of the engine compartment 20. The first work implement 4 includes a blade 15 and a blade control cylinder 16. The blade control cylinder 16 is a hydraulic cylinder. The blade 15 is disposed in front of the vehicle body 3 and is provided in a manner that allows movement in the up-down direction. The blade control cylinder 16 includes a first cylinder 16*a*, a second cylinder 16*b*, a third cylinder 16*c*, and a fourth cylinder 16*d*.

The first cylinder 16*a* and the second cylinder 16*b* are respectively attached to the corner part in the right front direction and the corner part in the left front direction of the engine compartment 20 as seen from above. The third cylinder 16*c* and the fourth cylinder 16*d* are connected to the first work implement 4 and a frame that supports the first work implement 4, the frame and the first work implement 4 being attached to the travel device 2. That is, the third cylinder 16*c* and the fourth cylinder 16*d* are attached to the travel device 2.

The first cylinder 16*a* and the second cylinder 16*b* are so-called lift cylinders and move the blade 15 up and down. The third cylinder 16*c* and the fourth cylinder 16*d* are so-called tilt cylinders and control the pitch angle of the blade 15. Although not illustrated, the blade 15 may be configured so that the angle can be changed with an angle cylinder.

The front end part FE of the engine compartment 20 is positioned on the rear side of the front end part WFE (in FIG. 2, the symbol WFE is attached to the second crawler belt 12) of the travel device 2. In a conventional bulldozer in which the first cooling device 48 is disposed on the front side of the engine 24, the front end part FE of the engine compartment 20 is positioned on the front side of the front end part WFE of the travel device 2.

Figure 6:
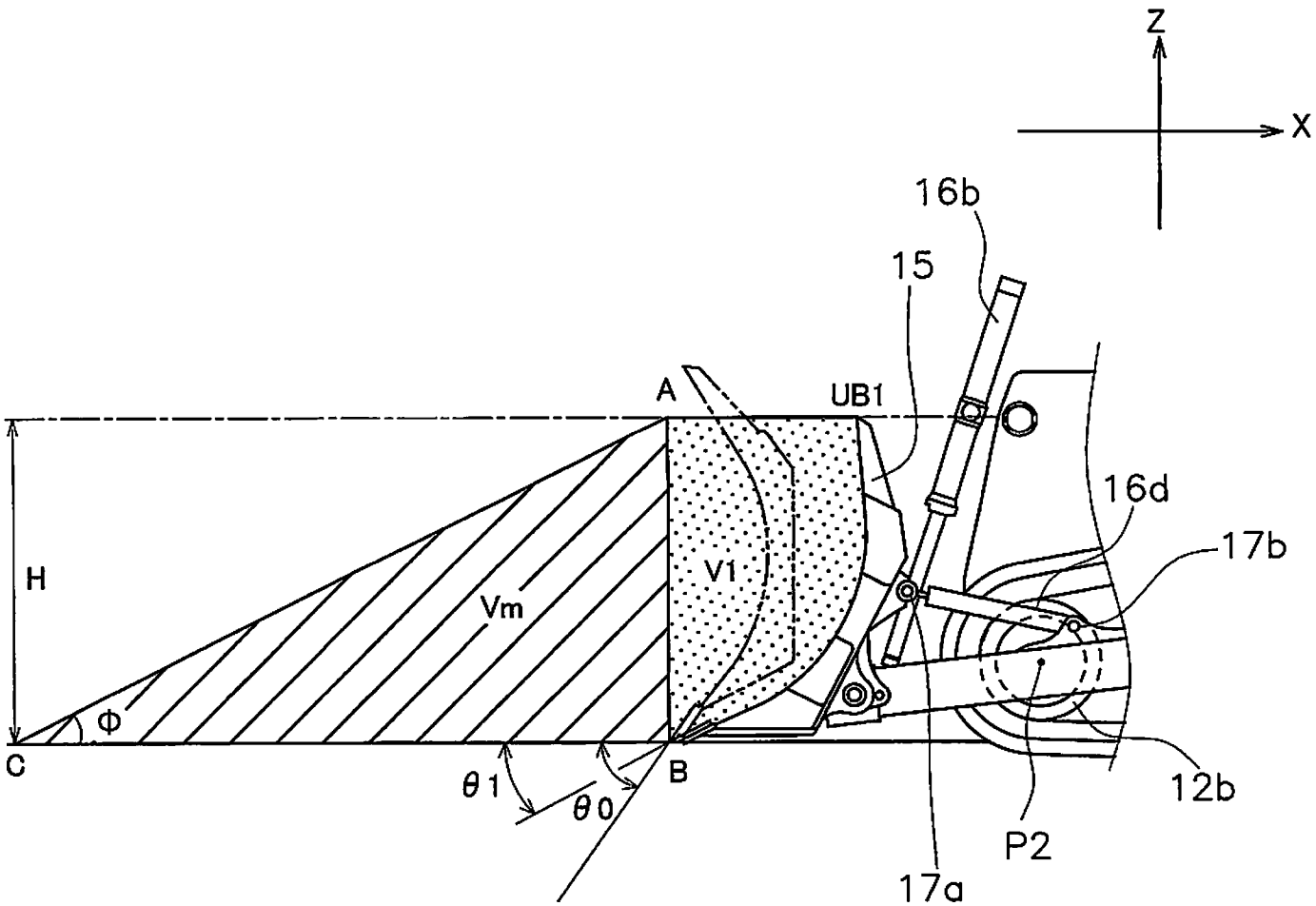
FIG. 6 is a view illustrating a pitch back amount of the work vehicle according to the first exemplary embodiment.
Figure 7:
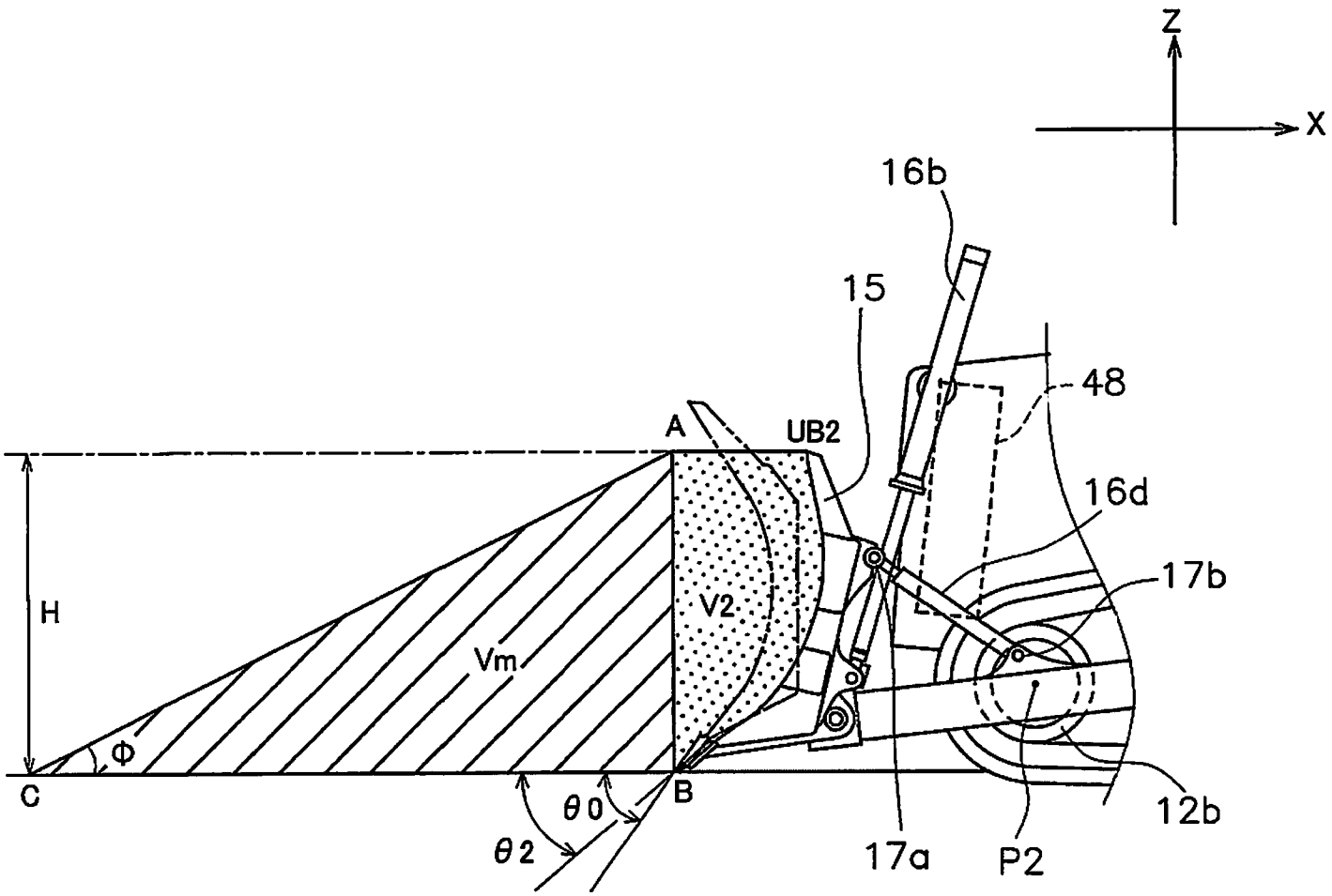
FIG. 7 (PRIOR ART)
FIG. 7 is a view illustrating a pitch back amount of a conventional bulldozer.

When the blade 15 is disposed in the same position as the conventional manner in the work vehicle 1 of the present exemplary embodiment, the operating range of the blade 15 can be increased. For example, the maximum lift amount due to the above-mentioned lift cylinder, the maximum angle change amount due to the angle cylinder, and the maximum pitch back angle due to the tilt cylinder can be increased. The pitch back angle is the rotational angle of the blade 15 when the blade 15 is made to rotate in front-back direction of the vehicle. FIG. 6 is a view illustrating the maximum pitch back angle of the work vehicle 1 according to the present exemplary embodiment. FIG. 7 is a view illustrating the maximum pitch back amount of a conventional bulldozer. In FIGS. 6 and 7, the standard attitude which is the normal attitude of the blade 15 is depicted with chain double-dashed lines.

When referring to FIGS. 1 and 6, the fourth cylinder 16*d* includes a first cylinder connecting part 17*a* that is connected to the blade 15 and a second cylinder connecting part 17*b* that is the connecting part on the opposite side from the first connecting part. The second cylinder connecting part 17*b* is positioned rearward of the center of rotation P2 of the second driven wheel 12*b*. Conversely, the second cylinder connecting part 17*b* is positioned in front of the center of rotation P2 of the second driven wheel 12*b* in the conventional bulldozer in FIG. 7. By positioning the second cylinder connecting part 17*b* rearward of the center of rotation P2 of the second driven wheel 12*b*, the stroke length in the front-back direction of the fourth cylinder 16*d* can be made to be longer in the work vehicle 1 than in the conventional bulldozer.

The positional relationship between the third cylinder 16*c* and the driven wheel of the first crawler belt 11 is the same as the positional relationship between the fourth cylinder 16*d* and the driven wheel of the second crawler belt 12. Therefore, when the blade 15 is disposed in the same position as the conventional position, the maximum pitch back angle can be increased due to the pitch cylinders 16*c* and 16*d* in the work vehicle 1 of the present exemplary embodiment.

Due to the structures of the first crawler belt 11 and the second crawler belt 12, the drive wheel may be the rotating member closest to the front end part WFE of the travel device 2. In this case, the cylinder connecting parts for connecting with the travel device 2 of the third cylinder 16*c* and the fourth cylinder 16*d*, are positioned rearward of the center of rotation of the drive wheel.

The following incidental effects can be found by increasing the maximum pitch back angle.

In FIGS. 6 and 7, B is a point that represents the blade tip position of the blade 15 and A is a point that represents a position vertically above the blade tip position of the blade 15 and the position at the height H that is the upper end of the blade 15. C is defined as the angle of repose φ of the earth and sand when the blade 15 is carrying earth and sand. UB1 is a point indicating the upper end of the blade 15 of the work vehicle 1 according to the present exemplary embodiment. UB2 is a point indicating the upper end of the blade 15 of the conventional bulldozer.

In FIGS. 6 and 7, θ0 represents the angle formed by the blade tip of the blade 15 with the ground surface while the blade 15 is in the standard attitude. In FIG. 6, θ1 represents the angle formed by the blade tip of the blade 15 with the ground surface when the pitch angle is at the maximum amount in the work vehicle 1. In FIG. 7, 02 represents the angle formed by the blade tip of the blade 15 with the ground surface when the pitch angle is at the maximum amount in the conventional bulldozer. θ0-θ1 is the maximum pitch back angle of the work vehicle 1 and θ0-θ2 is the maximum pitch back angle of the conventional bulldozer. As can be seen in FIGS. 6 and 7, the maximum pitch back angle of the work vehicle 1 (θ0-θ1) is greater than the maximum pitch back angle of the conventional bulldozer (θ0-θ2).

The resistance received by the work vehicle from the earth and sand to be carried is caused by an earth amount Vm enclosed in ABC in FIG. 6 or FIG. 7. The portion corresponding to the earth amount Vm is depicted with hatching in FIG. 6 and FIG. 7. The earth amount Vm depends upon the height H of the earth and sand to be carried and the angle of repose φ of the earth and sand. The earth amount V1 enclosed by ABUB1 in FIG. 6 and the earth amount V2 enclosed by ABUB2 in FIG. 7 is referred to as the blade holding volume. The portions corresponding to the earth amount V1 in FIG. 6 and the portion corresponding to the earth amount V2 in FIG. 7 are represented by a dot pattern.

The maximum pitch back angle of the work vehicle 1 is larger than that of the conventional bulldozer, and therefore the blade holding volume V1 of the work vehicle 1 can be larger than the blade holding volume V2 of the conventional bulldozer. Therefore, the earth amount that can be carried by the blade increases in correspondence to an increase in the size of the maximum pitch back angle. If the height H of the mound formed by the earth amount V were the same as that of the conventional bulldozer, the size of the blade 15 would need to be larger than that of the conventional blade.

Furthermore, because the front end part FE of the engine compartment 20 in FIG. 2 is positioned to further the rear of the travel device 2 than that conventional bulldozer, the blade 15 can be closer to the travel device 2 than in the case of the conventional bulldozer. Because the blade tip of the blade 15 can be closer to the gravity center position of the work vehicle 1, the excavation force of the work vehicle 1 can be increased. When the blade 15 is closer to the travel device 2 than the conventional case without changing the attachment position of the lift cylinders 16*a* and 16*b*, the lift cylinders 16*a* and 16*b* can be inclined at an angle closer to the vertical direction. In this case, the force of the lift cylinders 16*a* and 16*b* can be effectively transmitted to the blade 15.

When referring to FIG. 1, the second work implement 5 is disposed on the rear side of the vehicle body 3. Work performed with the second work implement 5 in the work vehicle 1 includes piercing stone with a ripper point 5*b* attached to the tip of a shank 5*a* that protrudes substantially straight downward, and the stone is broken and pulverized due to the tractive force from the travel device 2. Moreover, the second work implement 5 is driven by hydraulic cylinders (ripper lift cylinder 18, ripper tilt cylinder 19).

Second Exemplary Embodiment

Figure 8:
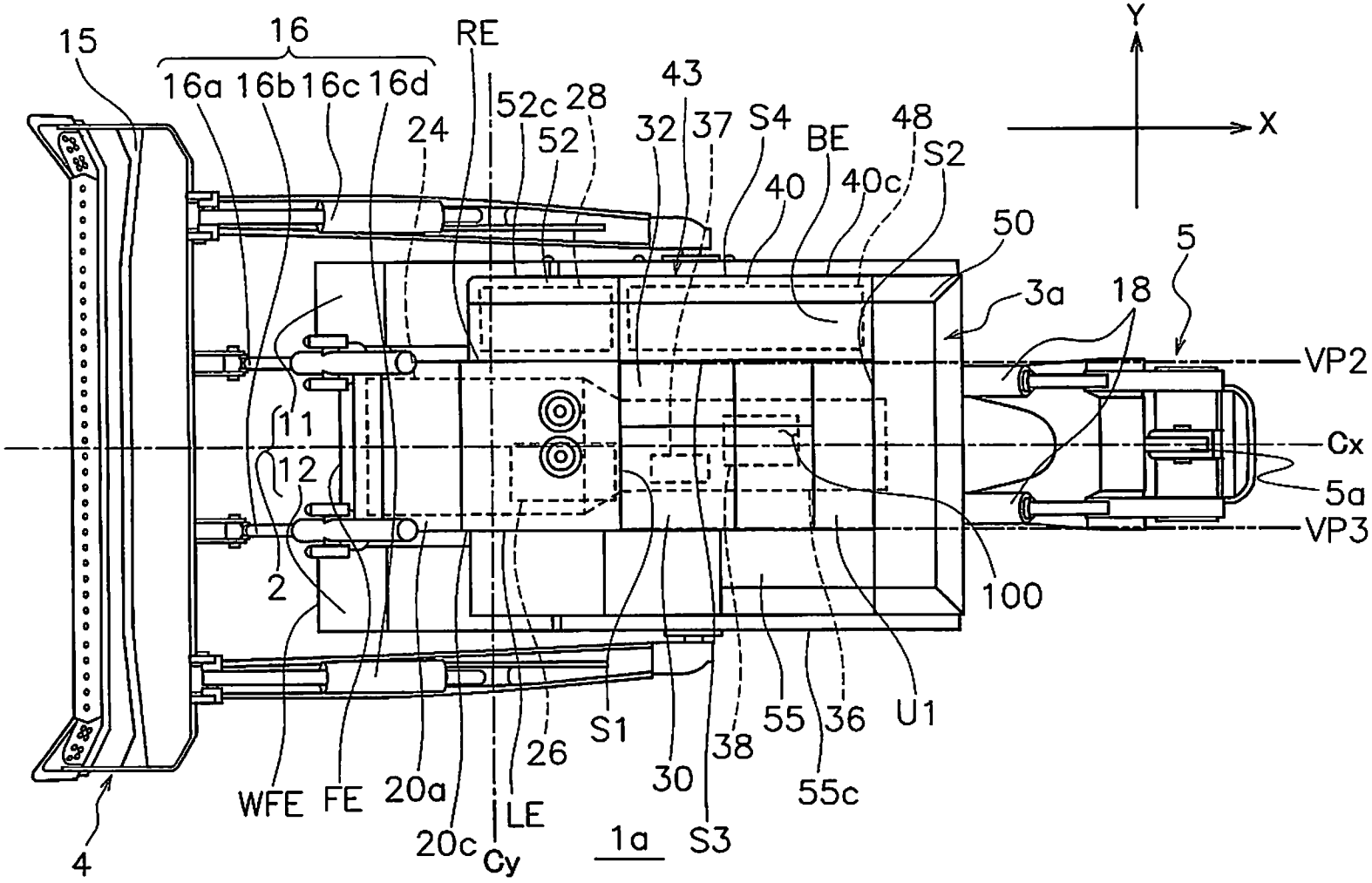
FIG. 8 is a top view of the work vehicle according to a second exemplary embodiment.
Figure 9:
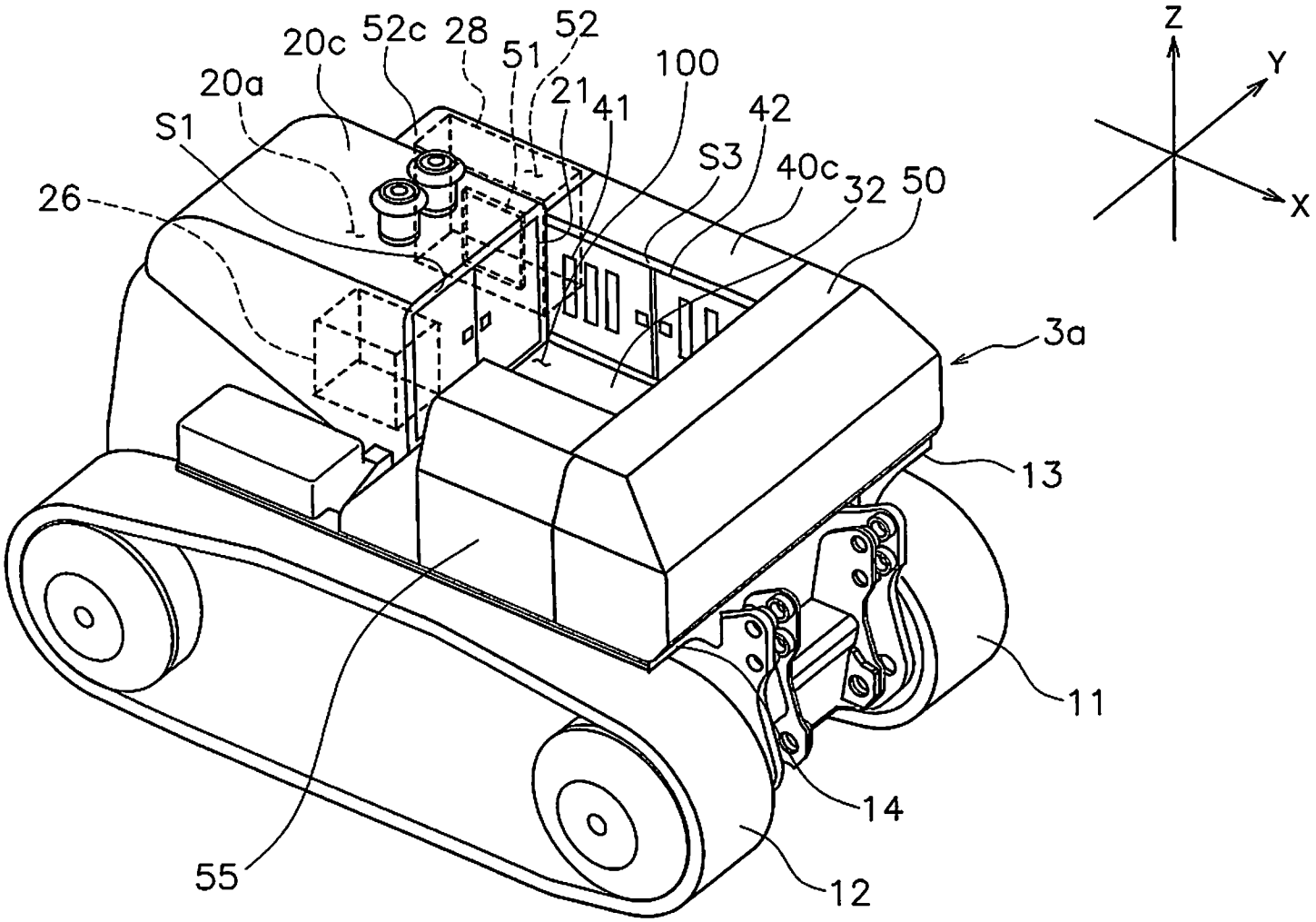
FIG. 9 is a perspective view of the work vehicle according to the second exemplary embodiment.

FIG. 8 is a top view of a work vehicle 1*a* according to a second exemplary embodiment. FIG. 9 is a perspective view of the work vehicle 1*a* according to the second exemplary embodiment. The second crawler belt 12 is depicted schematically in FIG. 9. The illustration of the first cooling device 48 is omitted in FIG. 9 for ease of explanation. The work vehicle 1*a* according to the second exemplary embodiment differs in that the exhaust processing device 26 and the after-cooler 28 of the work vehicle 1 according to the first exemplary embodiment are in different positions. Furthermore, the work vehicle 1*a* is provided with an after-cooler storage compartment 52 that contains the after-cooler 28. The shape of the engine compartment 20 is altered slightly accompanying the above changes.

Other configurations of the work vehicle 1*a* are the same as the configurations of the work vehicle 1. Therefore, only the configurations that differ between the work vehicle 1*a* and the work vehicle 1 will be discussed in the present exemplary embodiment, and other discussions will be omitted.

As can be seen in FIG. 8, a vehicle body 3*a* of the work vehicle 1*a* according to the present exemplary embodiment is further provided with a fourth cladding member 52*c* that covers the after-cooler 28. The area enclosed by the fourth cladding member 52*c* is referred to as the after-cooler storage compartment 52. The after-cooler storage compartment 52 contains the after-cooler 28. The after-cooler storage compartment 52 has a substantially square column shape.

The after-cooler storage compartment 52 abuts an engine compartment 20*a* according to the present exemplary embodiment on the right side (on the outside in the vehicle width direction of the engine compartment 20*a*) of the engine compartment 20*a*. The after-cooler storage compartment 52 extends to the rear on the rear side of the center line Cy in the front-back direction of the engine compartment 20*a*. The rear end of the after-cooler storage compartment 52 is adjacent to the cooling device compartment 40. The first side surface S1 of the engine compartment 20*a* is shifted in the forward direction in comparison to the first side surface S1 of the engine compartment 20 of the first exemplary embodiment. The first cooling device 48 is positioned rearward of the first side surface S1.

The exhaust processing device 26 is disposed in the engine compartment 20*a* on the rear side of the center Cy in the front-back direction of the engine compartment 20*a*. The exhaust processing device 26 is disposed toward the rear side of the engine compartment 20*a*. As can be seen in FIG. 9, an opening 51 is provided at a connection part of the engine compartment 20*a* and the after-cooler storage compartment 52. A worker is able to access the after-cooler 28 from the side of the engine compartment 20*a* by opening the third inspection port 21. The worker is able to easily perform maintenance on the after-cooler 28 by entering the work area 100.

Third Exemplary Embodiment

Figure 10:
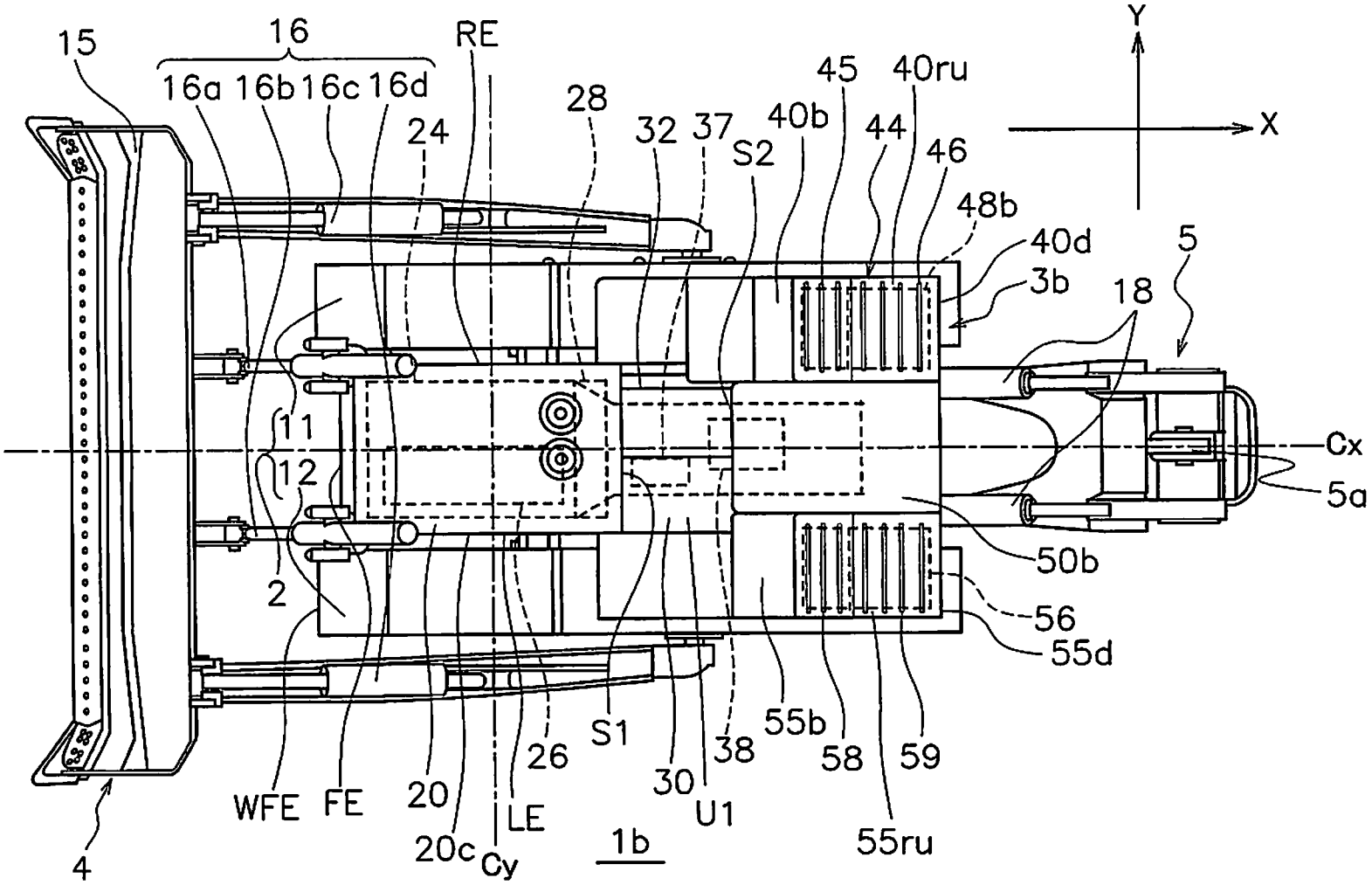
FIG. 10 is a top view of the work vehicle according to a third exemplary embodiment.
Figure 11:
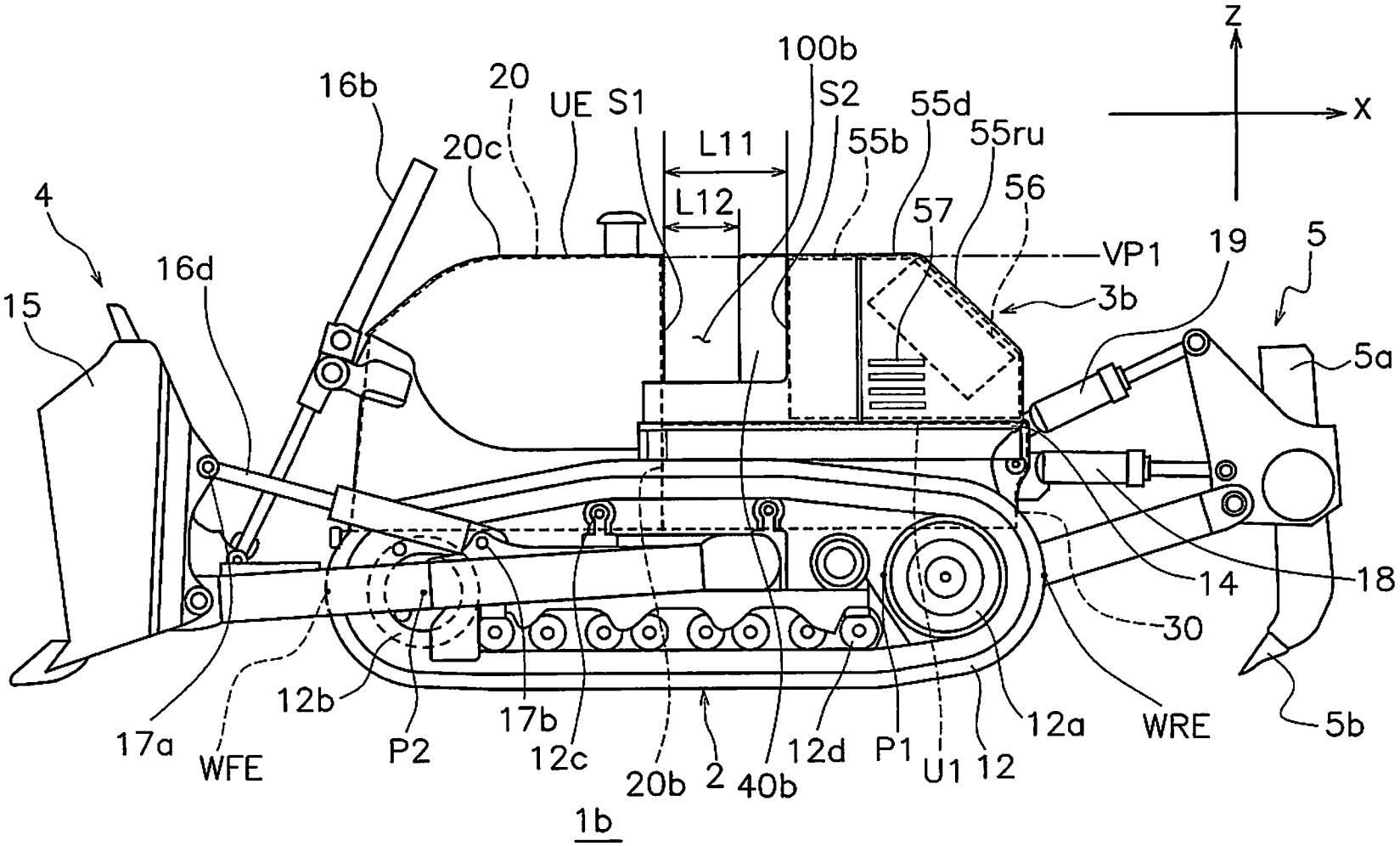
FIG. 11 is a side view of a work vehicle according to the third exemplary embodiment.

FIG. 10 is a top view of a work vehicle 1*b* according to a third exemplary embodiment of the present invention. FIG. 11 is a side view of the work vehicle 1*b*. The work vehicle 1*b* according to the third exemplary embodiment is not provided with the cover 6. The configurations of the cooling device compartment 40, the fuel tank 50, and the first additional storage compartment 55 in the third exemplary embodiment differ from the configurations illustrated in the first exemplary embodiment, but other configurations are the same. Only the configurations that differ between the work vehicle 1*b* and the work vehicle 1 will be discussed in the present exemplary embodiment, and other discussions will be omitted.

When referring to FIG. 10, a first cooling device 48*b* according to the present exemplary embodiment is smaller than the first cooling device 48 of the first exemplary embodiment. The first cooling device 48*b* extends rearward on the rear side of the first side surface S1 as can be seen from above. The first cooling device 48*b* is spaced away from the engine compartment 20. The first cooling device 48*b* is disposed in a corner part of the right rear end of a vehicle body 3*b*. The first cooling device 48*b* is disposed in the end part (rear part) of the vehicle body 3*b* and is disposed in the end part on the right side of the vehicle body 3*b*.

The first cooling device 48*b* overlaps the first crawler belt 11 as seen from above. The first cooling device 48*b* is positioned on the right side of the center Cx in the vehicle width direction of the vehicle body 3*b*. The first cooling device 48*b* is disposed rearward of the engine 24 and on one side in the vehicle width direction of the vehicle body 3.

A second cladding member 40*d* for a cooling device compartment 40*b* covers the first cooling device 48*b*. The cooling device compartment 40*b* contains the first cooling device 48*b*. The second cladding member 40*d* does not include the second inspection port 42. The cooling device compartment 40*b* has a columnar shape having a side surface 40*ru* that is inclined upward and rearward. The second cladding member 40*d* of the cooling device compartment 40*b* has the side surface 40*ru* that is inclined upward and rearward.

The cooling device compartment 40*b* extends rearward on the rear side of the first side surface S1 as can be seen from above. The cooling device compartment 40*b* is spaced away from the engine compartment 20. The cooling device compartment 40*b* overlaps the first crawler belt 11 as seen from above. More specifically, the cooling device compartment 40*b* is disposed in a corner part of the right rear end of a vehicle body 3*b* in the third exemplary embodiment. The cooling device compartment 40*b* is disposed in the end part (rear part) of the vehicle body 3*b* and is disposed in the end part on the right side of the vehicle body 3*b*. The cooling device compartment 40*b* is positioned on one side of the center Cx in the vehicle width direction of the vehicle body 3*b*.

The work vehicle 1*b* according to the present exemplary embodiment further includes a second cooling device 56. The second cooling device 56 includes a radiator that cools a coolant for cooling the engine 24, for example, and may further include an oil cooler that cools the hydraulic fluid. The second cooling device 56 may further include an oil cooler that cools the lubricating oil of the power transmission mechanism 36. The second cooling device 56 is preferably a cooling device that is the same as the first cooling device 48*b* from the viewpoint of the weight balance of the work vehicle 1*b*.

The second cooling device 56 extends rearward on the rear side of the first side surface S1 as seen from above. The second cooling device 56 is spaced away from the engine compartment 20. The second cooling device 56 overlaps the second crawler belt 12 as seen from above. The second cooling device 56 is disposed in a corner part of the left rear end of a vehicle body 3*b*. The second cooling device 56 is disposed in the end part (rear part) of the vehicle body 3*b* and is disposed in the end part on the left side of the vehicle body 3*b*.

The second cooling device 56 is positioned on the left side of the center Cx in the vehicle width direction of the vehicle body 3*b*. The second cooling device 56 is disposed on the opposite side (other side in the vehicle width direction of the vehicle body 3*b*) of the side where the first cooling device 48*b* is disposed in the vehicle width direction of the vehicle body 3*b*. The second cooling device 56 is disposed away from the first cooling device 48*b* rearward of the engine 24.

The second cooling device 56 is covered by a third cladding member 55*d* of a first additional storage compartment 55*b*. The second cooling device 56 is stored in the first additional storage compartment 55*b*. The first additional storage compartment 55*b* has a columnar shape having a side surface 55*ru* that is inclined upward and rearward. The third cladding member 55*d* has the side surface 55*ru* that is inclined upward and rearward. The first additional storage compartment 55*b* extends rearward on the rear side of the first side surface S1 as can be seen from above. The first additional storage compartment 55*b* is spaced away from the engine compartment 20. The first additional storage compartment 55*b* overlaps the second crawler belt 12 as seen from above.

The first additional storage compartment 55*b* is disposed in a corner part of the left rear end of a vehicle body 3*b*. The first additional storage compartment 55*b* is disposed in the end part (rear part) of the vehicle body 3*b* and is disposed in the end part on the left side of the vehicle body 3*b*. The first additional storage compartment 55*b* is positioned on the left side of the center Cx in the vehicle width direction of the vehicle body 3. The first additional storage compartment 55*b* is disposed on the opposite side (other side in the vehicle width direction of the vehicle body 3*b*) of the side where the cooling device compartment 40*b* is disposed in the vehicle width direction of the vehicle body 3*b*. The first additional storage compartment 55*b* is disposed away from the cooling device compartment 40*b* rearward of the engine 24.

When referring to FIG. 11, the first additional storage compartment 55*b* is disposed above the power transmission mechanism compartment 30. The second cooling device 56 is inclined upward and rearward. Ventilation holes 57 are formed in the left side surface (side surface of opposite side from surface facing the center Cx on the vehicle width direction of the vehicle body 3*b*) in the first additional storage compartment 55*b*. When referring to FIG. 10, ventilation holes 58 are formed on the top surface and ventilation holes 59 are formed in the side surface 55*ru* inclined upward and rearward of the first additional storage compartment 55*b*. The third cladding member 55*d* includes the ventilation holes 57, 58, and 59. Air drawn in from the ventilation holes 57 and 58 is fed to the second cooling device 56. The air that has passed through the second cooling device 56 is exhausted from the ventilation holes 59.

Figure 12:
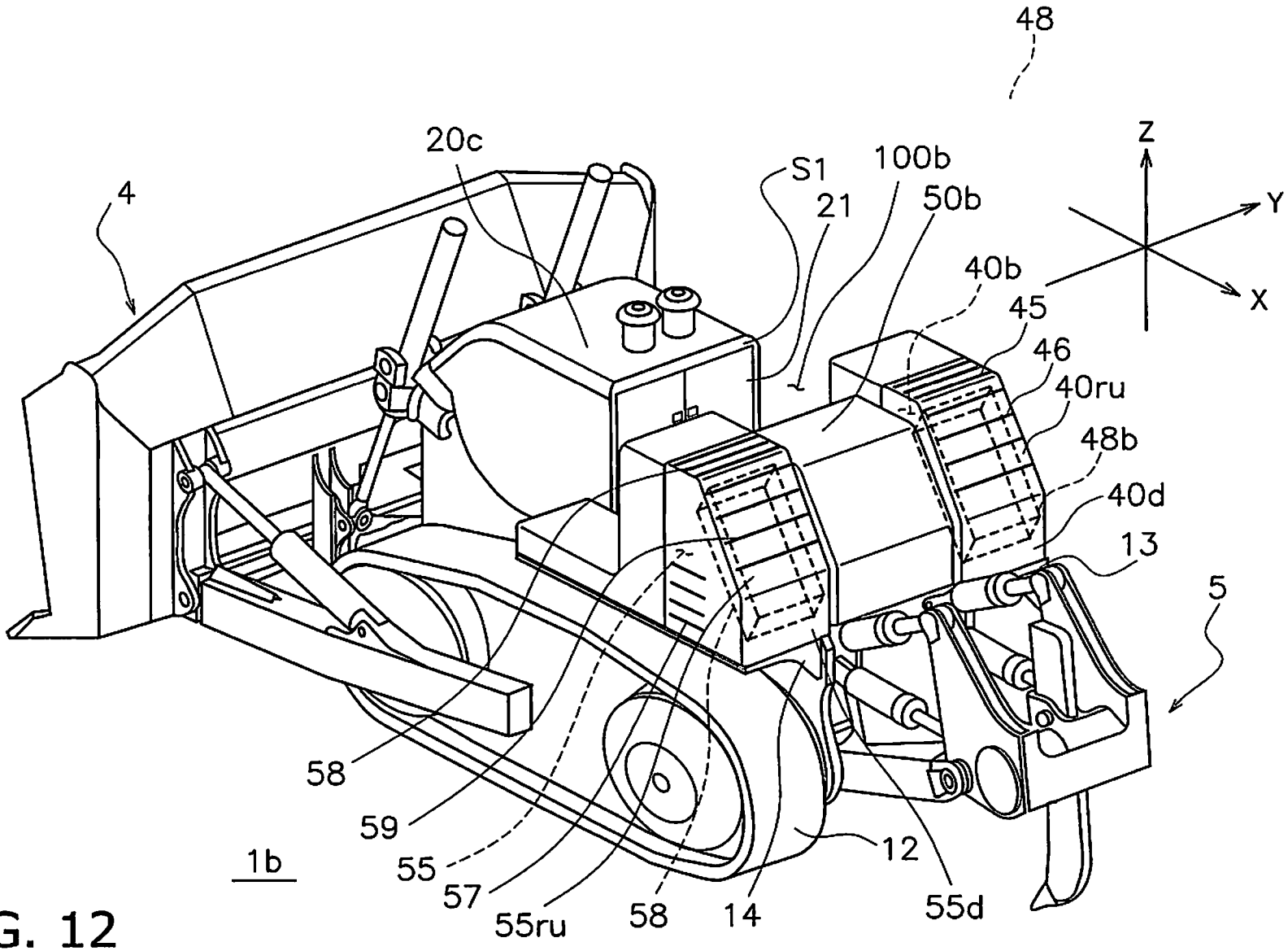
FIG. 12 is a perspective view of the work vehicle according to the third exemplary embodiment.

FIG. 12 is a perspective view of the work vehicle 1*b* according to the third exemplary embodiment. The second crawler belt 12 is depicted schematically in FIG. 12. When referring to FIG. 12, the first cooling device 48*b* is also inclined upward and rearward. Furthermore, ventilation holes 45 are formed on the top surface of the cooling device compartment 40*b* and ventilation holes 46 are formed in the side surface 40*ru* inclined upward and rearward. Additionally, ventilation holes 44 are formed in the right side surface (side surface of opposite side from surface facing the center Cx on the vehicle width direction of the vehicle body 3*b*) of the cooling device compartment 40*b* as illustrated in FIG. 10 The second cladding member 40*d* includes the ventilation holes 44, 45 and 46.

Air drawn in from the ventilation holes 44 and 45 is fed to the first cooling device 48*b*. Air that has passed through the first cooling device 48*b* is exhausted from the ventilation holes 46.

The work vehicle 1*b* of the present exemplary embodiment is provided with the second work implement (ripper) 5. Earth and stones are scattered upward during work with the ripper. However, the possibility of intrusion of pulverized earth and stones from the ventilation holes 46 and 59 is low due to the first cooling device 48*b* and the second cooling device 56 being inclined upward and rearward. Therefore, the durability of the first cooling device 48*b* and the second cooling device 56 is improved.

When referring to FIG. 12, a fuel tank 50*b* according to the present exemplary embodiment also has a square column shape having a side surface that is inclined upward and rearward. When referring to FIG. 10, the fuel tank 50*b* is positioned in the end part (rear part) on the rear side of the vehicle body 3*b*. The fuel tank 50*b* is spaced away from the engine compartment 20. The fuel tank 50*b* extends in the vehicle width direction relative to the center Cx of the vehicle body 3 in the vehicle width direction. The fuel tank 50*b* is disposed above the power transmission mechanism compartment 30. The fuel tank 50*b* is disposed between the cooling device compartment 40*b* and the first additional storage compartment 55*b*.

A first distance L11 which is the distance in the front-back direction between the first side surface S1 and the second side surface S2 illustrated in FIG. 11, is shorter than the first distances L1 depicted in the first exemplary embodiment and the second exemplary embodiment. That is, a work area 100*b* in the third exemplary embodiment is narrower than the work areas 100 in the first exemplary embodiment and the second exemplary embodiment. As illustrated in FIG. 10, the control valve 38 is difficult to access even when the hatch 32 is open. The first distance L11 is preferably provided with a distance to allow the third inspection port 21 to be opened.

The distance between the first additional storage compartment 55*b* and the engine compartment 20 in the third exemplary embodiment is the first distance L11. The distance L11 between the first additional storage compartment 55*b* and the engine compartment 20 is greater than a distance L12 between the cooling device compartment 40*b* and the engine compartment 20. In this case, the longer distance L11 has, for example, a width of 450 mm or greater which is the passageway width for lateral walking on a construction machine, as prescribed in ISO 2867. Conversely, if the distance L12 is greater than the distance L11, the distance L12 may be equal to or greater than the afore-mentioned distance.

Fourth Exemplary Embodiment

Figure 13:
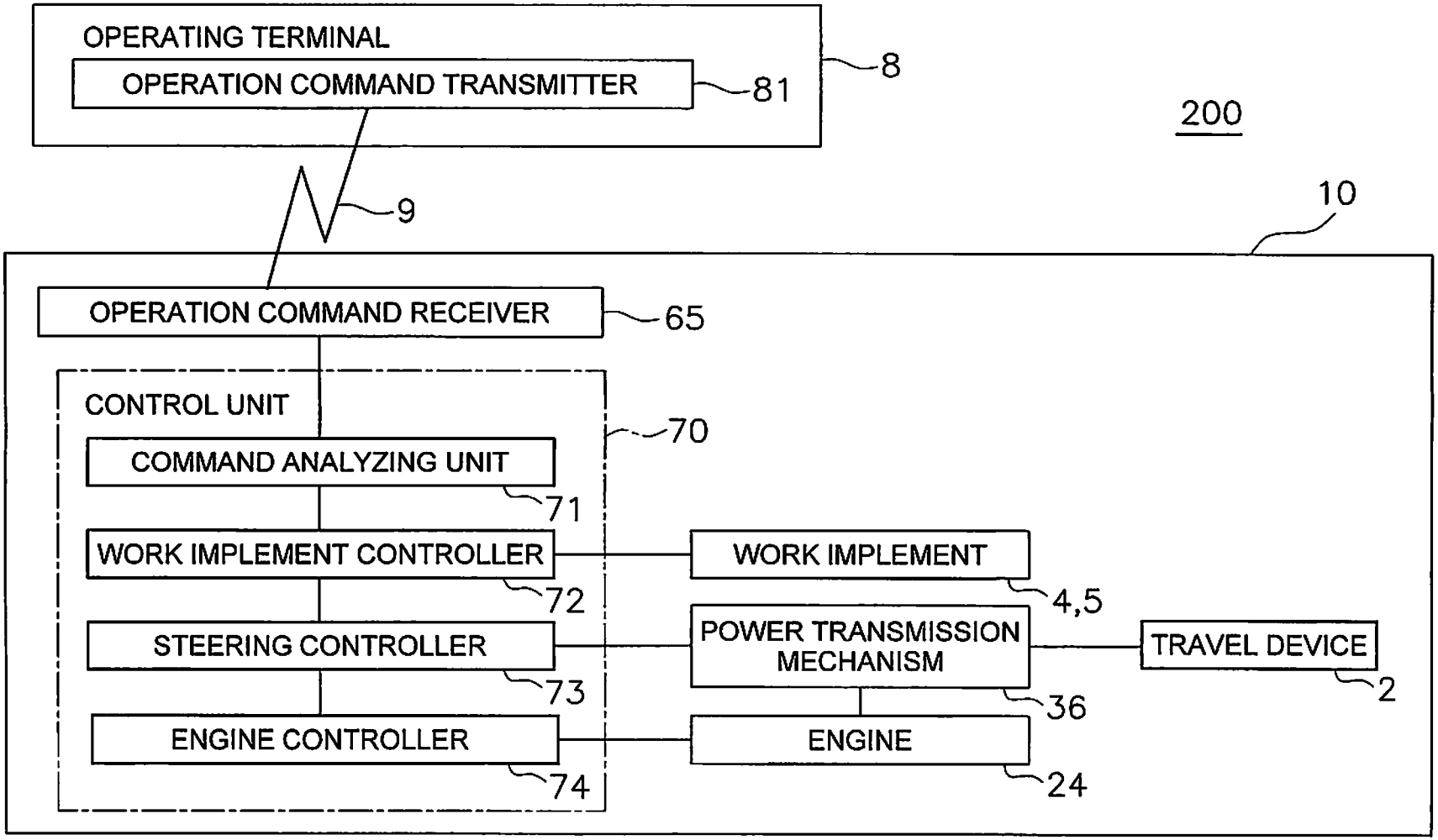
FIG. 13 is a block diagram of a control system for controlling the work vehicle according to the first to third exemplary embodiments.

The fourth and fifth exemplary embodiments discuss configurations of control systems for allowing the work vehicles 1, 1*a* and 1*b* according to the first to third exemplary embodiments to operate as unmanned vehicles. A vehicle control system for allowing the work vehicles 1, 1*a*, and 1*b* to be operated remotely will be discussed in the fourth exemplary embodiment. FIG. 13 is a block diagram of a control system 200. The control system 200 is provided with an operating terminal 8, a communication means 9, and a work vehicle 10. The work vehicle 10 represents any one of the work vehicle 1 according to the first exemplary embodiment, the work vehicle 1*a* according to the second exemplary embodiment, and the work vehicle 1*b* according to the third exemplary embodiment.

The operating terminal 8 represents a computer or a dedicated terminal for remote control. The operation contents (travel, work implement operations and the like) of the work vehicle 10 are input by an operator to the operating terminal 8. The operating terminal 8 generates operation commands which are communication data describing the input operation contents, and transmits the operation commands from an operation command transmitter 81 to the work vehicle 10 via the communication means 9. The communication means 9 is a communication means for wired communication or for wireless communication such as communication using satellite communication or a mobile telephone network.

The work vehicle 10 is provided with an operation command receiver 65, a control unit 70, the work implements 4 and 5, the power transmission mechanism 36, the travel device 2, and the engine 24. The work implements 4 and 5, the power transmission mechanism 36, the travel device 2, and the engine 24 are described in detail in the first exemplary embodiment and explanations thereof will be omitted.

The control unit 70 includes a command analyzing unit 71, a work implement controller 72, a steering controller 73, and an engine controller 74. The operation command receiver 65 receives the operation commands transmitted by the communication means 9. The operation command receiver 65 receives operation commands transmitted from outside of the work vehicle 10. When the communication means 9 is wireless communication, the operation command receiver 65 includes an antenna function.

The control unit 70 includes a processor, such as a CPU, a storage device, such as a RAM or a ROM, and controls the work implements 4 and 5 and the travel device 2 according to the operation commands. Typically, programs and data for executing the functions of the command analyzing unit 71, work implement controller 72, the steering controller 73, and the engine controller 74 are stored in the storage device. The processor executes the programs whereby the control unit 70 executes the functions of the command analyzing unit 71, the work implement controller 72, the steering controller 73, and the engine controller 74. The control unit 70 may be realized by an integrated circuit.

The command analyzing unit 71 analyzes the operation commands received by the operation command receiver 65 and determines the operation amounts of the work implements 4 and 5, and the traveling direction and speed and the like of the travel device 2. The work implement controller 72 determines the operation amounts for the hydraulic cylinders (for example, the first to fourth cylinders 16*a*-16*d*, the ripper lift cylinder 18, the ripper tilt cylinder 19) for actuating the work implements 4 and 5, and controls the control valves of the cylinders on the basis of the determined operation amounts of the work implements 4 and 5.

The steering controller 73 determines the control amounts of the clutches and brakes and the like of the power transmission mechanism 36 on the basis of the determined traveling direction and speed of the travel device 2. The steering controller 73 determines the hydraulic pressure to be supplied to the clutches and brakes and controls the control valves (for example, the control valve 38) related to the clutches and brakes.

The engine controller 74 calculates the engine horsepower for generating driving power for making the speed of the travel device 2 achieve the determined speed as well as for the driving power of the hydraulic pump calculated by the work implement controller 72. The engine controller 74 controls the engine 24 so as to be able to output the horsepower.

The work vehicle 10 may also be provided with: an environmental sensor, such as a camera, a radar, and an ultrasonic sensor and the like; a positional sensor, such as a GPS and the like; an attitude detecting sensor, such as a gyroscope, an acceleration sensor, and angle sensors for the links to the work implements 4 and 5; and a vehicle information transmitter. The environmental sensor detects the conditions in the vicinity of the work vehicle 10. The positional sensor measures the position of the work vehicle 10. The attitude detecting sensor measures the attitude of the work vehicle 10 and the attitudes of the work implements 4 and 5. The vehicle information transmitter transmits the information of the environmental sensor, the positional sensor, and the attitude sensor to the operating terminal 8 via the communication means 9.

The operating terminal 8 may be further provided with a receiver and a display and the like. The receiver receives the information of the environmental sensor, the positional sensor, and the attitude sensor transmitted by the transmitter. The display displays the information of the environmental sensor, the positional sensor, and the attitude sensor. In this case, an operator is able to transmit operation commands to the work vehicle 10 remotely without being present at the work site of the work vehicle 10.

Fifth Exemplary Embodiment

Figure 14:
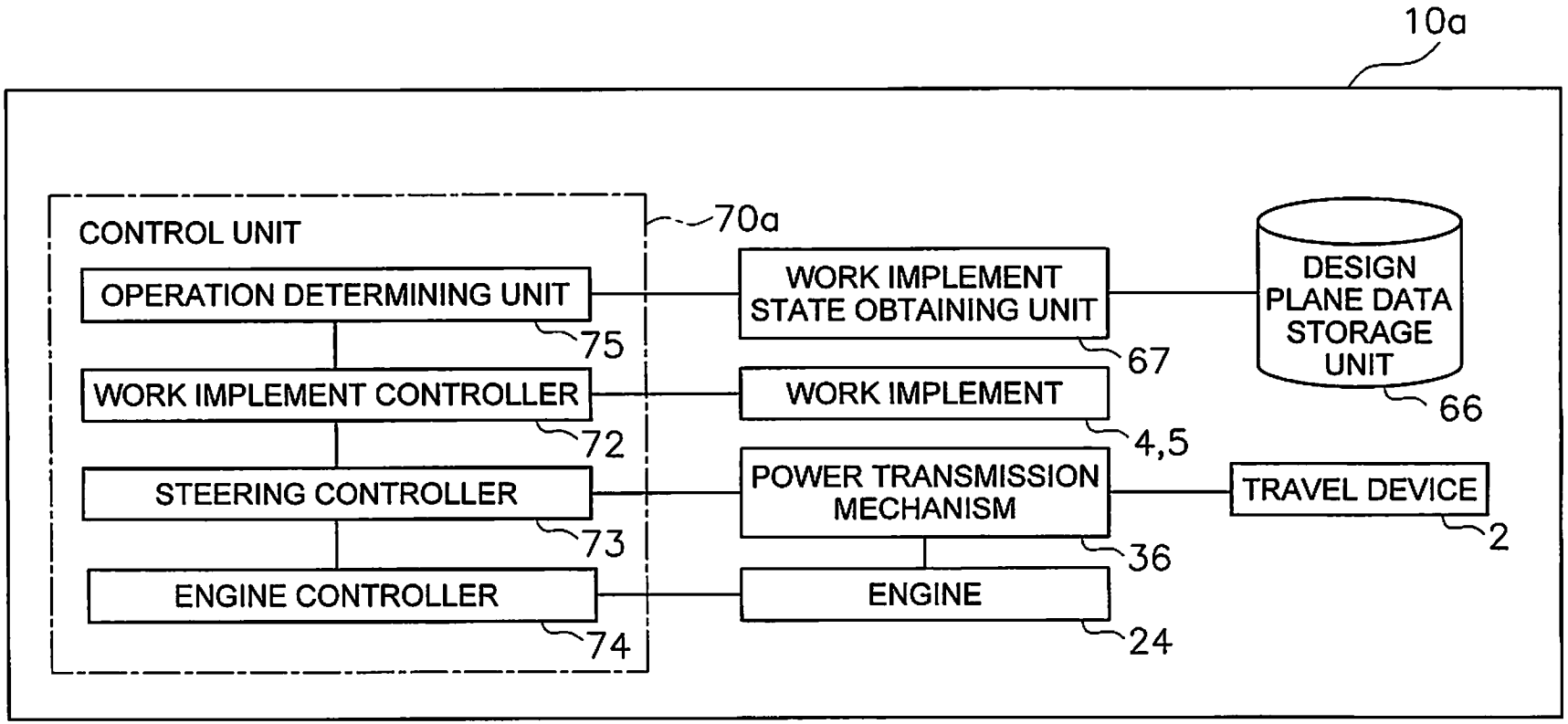
FIG. 14 is a control block diagram for controlling the work vehicle according to the first to third exemplary embodiments.

An example of a vehicular control system of the work vehicles 1, 1*a*, and 1*b* for carrying out excavation and leveling work automatically without commands from an operator will be explained in the fifth exemplary embodiment. FIG. 14 is a block diagram of a work vehicle 10*a* according to the fifth exemplary embodiment. The work vehicle 10*a* represents any one of the work vehicle 1 according to the first exemplary embodiment, the work vehicle 1*a* according to the second exemplary embodiment, and the work vehicle 1*b* according to the third exemplary embodiment.

The work vehicle 10*a* is provided with a design plane data storage unit 66, a control unit 70*a*, a work implement state obtaining unit 67, the work implements 4 and 5, the power transmission mechanism 36, the travel device 2, and the engine 24. The control unit 70*a* includes an operation determining unit 75, the work implement controller 72, the steering controller 73, and the engine controller 74. Configurations that are the same as in the fourth embodiment will be provided with the same reference numerals and detailed explanations thereof will be omitted.

The design plane data storage unit 66 stores data of a design plane, which is a work target. The design plane is a three-dimensional design terrain that indicates a target shape to be excavated. The design plane data storage unit 66 may be realized by an optical disk, such as a CD-ROM, a DVD, or a BD, or by portable memory, such as a memory card or a USB memory. Alternatively, the design plane data storage unit 66 may be realized by a storage device fixed to the work vehicle 10*a*. When the design plane data storage unit 66 is a fixed storage device, the work vehicle 10*a* is provided with a communication means or an input means such as wireless communication or serial communication for inputting data of the design plane into the design plane data storage unit 66.

The work implement state obtaining unit 67 obtains the position attitudes of the work implements 4 and 5. The work implement state obtaining unit 67 includes at least a positional sensor (GPS and the like) and an attitude detecting sensor (gyroscope, acceleration sensor, angle sensor for the links of the work implements 4 and 5, etc.). The positional sensor measures the position of the work vehicle 10. The attitude detecting sensor measures the attitude of the work vehicle 10 and the attitudes of the work implements 4 and 5. The work implement state obtaining unit 67 calculates the positional relationship between the blade tips of the work implements 4 and 5 and the design plane based on the values of the above sensors. Moreover, the work implement state obtaining unit 67 may calculate the angle formed by the blade tips of the work implements 4 and 5 and the design plane based on the values of the above sensors.

The operation determining unit 75 controls the positional attitudes of the work implements 4 and 5 so that the blade tips of the work implements 4 and 5 follow the design plane, and makes the travel device 2 travel in the direction and speed appropriate for the design plane. The operation determining unit 75 determines the operation amounts of the work implements 4 and 5 and traveling direction and speed and the like of the travel device 2. Specifically, when the distance between the blade tips of the work implements 4 and 5 and the design plane is judged to be equal to or less than a predetermined threshold in accordance with the speed of the travel device 2, the blade is controlled to move upward as indicated in U.S. Pat. No. 5,167,1403, for example.

Alternative Exemplary Embodiments

Although the exemplary embodiments of the present invention have been described so far, the present invention is not limited to the above exemplary embodiments and various modifications may be made within the scope of the invention.

The present invention is not limited to the above-mentioned bulldozer and may be applied to another type of work vehicle, such as a wheel loader, a forklift, or a motor grader.

The work vehicles 1, 1*b*, 1*c*, 10, and 10*a* may be provided with a driving source, such as an electric motor in place of the engine 24. Alternatively, a hybrid driving source in which the engine 24 and an electric motor are combined may also be used. At least one of the driving sources may be stored in the engine compartment 20 in the work vehicles 1, 1*b*, 1*c*, 10 or 10*a* provided with the hybrid driving source.

The work areas 100 and 100*b* may be prescribed as a space narrower than the space enclosed by the first virtual plane VP1, the second virtual plane VP2, the third virtual plane VP3, the first side surface S1, the second side surface S2, and the first partition plate U1 is hollow. For example, the work areas 100 and 100*b* may be prescribed by the rotational range of the door the third inspection port 21, or the space above the hatch 32 may be defined as the work areas 100 and 100*b*.

The ventilation holes 6*a*, 41, 44, 45, 46, 57, 58, and 59 depicted in the drawings of the above exemplary embodiments are merely examples and may have other shapes. The shapes and functions of the first work implement 4, the second work implement 5, the first crawler belt 11, and the second crawler belt 12 are similarly not limited by the drawings of the above exemplary embodiments.

The characteristics of the work vehicle disclosed by the present description are as follows.

The engine 24 is disposed in the front part of the vehicle bodies 3, 3*a* and 3*b* in the work vehicles 1, 1*a* and 1*b*. The first cooling devices 48 and 48*b* are disposed rearward of the engine 24 and on one side in the vehicle width direction of the vehicle bodies 3, 3*a*, and 3*b*. Therefore, the inflow of earth and sand (for example, earth and sand leaking downward from the upper surface of the first work implement 4) from the ventilation holes of the first cooling device 48 during work can be limited. Consequently, the work vehicles 1, 1*a* and 1*b* are able to prevent a reduction in the performance of the first cooling device 48.

The vehicle bodies 3 and 3*a* have the work area 100 in a position facing the first cooling device 48 rearward of the engine 24. Therefore, maintenance of the first cooling device 48 is facilitated.

The after-cooler 28 is disposed between the engine 24 and the work area 100. Therefore, maintenance of the after-cooler 28 is facilitated.

The fuel tanks 50 and 50*b* are disposed in the rear part of the vehicle bodies 3, 3*a* and 3*b* and extend in the vehicle width direction with respect to the center in the vehicle width direction of the vehicle bodies 3, 3*a* and 3*b*. The vehicle body frame is provided at the end of the vehicle bodies 3, 3*a* and 3*b*. Therefore, the fuel tank 50 can be supported in a stable manner.

The first partition plate U1 which separates the work area 100 and the power transmission mechanism 36 has the hatch 32 (first inspection port). Therefore, maintenance of the power transmission mechanism 36 can be performed easily by opening the hatch 32.

The second cladding member 40*c* (first cover member) has the second inspection port 42 between the work area 100 and the first cooling device 48. Therefore, access from the work area 100 to the first cooling device 48 is facilitated.

The first cladding member 20*c* (second cover member) has the third inspection port 21 between the work area 100 and the engine 24. Therefore, access from the work area 100 to the after-cooler 28 and the exhaust processing device 26 is facilitated.

The first cladding member 20*c* (second cover member) has the third inspection port 21 between the work area 100 and the after-cooler 28. Therefore, maintenance of the after-cooler 28 from the work area 100 is further facilitated.

The first cooling device 48 overlaps the first crawler belt 11 in the first to third exemplary embodiments. Therefore, the distance of the work area 100 in the vehicle width direction can be increased. Consequently, the hatch 32 (first inspection port) can be widened. As a result, maintenance on the power transmission mechanism 36 and the devices (for example, the control valve 38) accompanied by the power transmission mechanism 36 is further facilitated. Moreover, a large amount of air can be drawn into the first cooling device 48 and the cooling efficiency of the first cooling device 48 is improved.

According to the present invention, there is provided a work vehicle in which the cooling device is disposed in a new location so that a reduction in the performance of the cooling device can be prevented.

The invention claimed is:

1. A work vehicle comprising:

a vehicle body;

a travel device provided below the vehicle body in a vertical direction of the work vehicle;

a driving source disposed inside a driving source compartment in a front part of the vehicle body in a longitudinal direction of the work vehicle, the driving source being configured to generate a driving power for the travel device; and a cooling device disposed rearward of the driving source in the longitudinal direction and on one side in a lateral direction of the vehicle body, the entire cooling device being disposed on one side of a lateral center of the vehicle body in the lateral direction and rearward of a transverse centerline of the driving source compartment in the longitudinal direction, the transverse centerline extending in the lateral direction, each of the vertical direction, the longitudinal direction, and the lateral direction being perpendicular to one another.

2. The work vehicle according to claim 1, wherein the vehicle body has a work area positioned facing the cooling device and rearward of the driving source.

3. The work vehicle according to claim 2, further comprising a device to be maintained that requires maintenance, the device being disposed between the driving source and the work area.

4. The work vehicle according to claim 3, further comprising a fuel tank disposed in a rear part of the vehicle body, the fuel tank extending in the lateral direction with respect to a center of the lateral direction of the vehicle body.

5. The work vehicle according to claim 3, further comprising a second cover member that covers the driving source, the second cover member having a third inspection port between the work area and the device to be maintained.

6. The work vehicle according to claim 3, further comprising a power transmission mechanism positioned below the work area, the power transmission mechanism being configured to transmit driving power generated by the driving source to the travel device; and a first partition plate having a first inspection port that allows communication from the work area to the power transmission mechanism, the first partition plate separating the work area and the power transmission mechanism.

7. The work vehicle according to claim 4, wherein the work area is surrounded by the cooling device, the device to be maintained, and the fuel tank.

8. The work vehicle according to claim 2, further comprising a power transmission mechanism positioned below the work area, the power transmission mechanism being configured to transmit driving power generated by the driving source to the travel device; and a first partition plate having a first inspection port that allows communication from the work area to the power transmission mechanism, the first partition plate separating the work area and the power transmission mechanism.

9. The work vehicle according to claim 2, further comprising a first cover member that covers the cooling device, the first cover member having a second inspection port between the work area and the cooling device.

10. The work vehicle according to claim 2, further comprising a second cover member that covers the driving source, the second cover member having a third inspection port between the work area and the driving source.

11. The work vehicle to claim 1, wherein the travel device has a crawler belt, the cooling device overlapping the crawler belt as seen from above in a top view of the work vehicle.

12. The work vehicle according to claim 1, wherein the entire cooling device is disposed on the one side of the driving source compartment in the lateral direction.

13. A work vehicle comprising:

a vehicle body;

a travel device provided below the vehicle body in a vertical direction of the work vehicle;

an engine compartment enclosing an engine in a front part of the vehicle body in a longitudinal direction of the work vehicle, the engine compartment defining the front part of the vehicle body;

a cooling device compartment housing a cooling device, the cooling device compartment extending rearward of the engine compartment in the longitudinal direction and disposed on one side of a lateral center of the work vehicle in a lateral direction of the work vehicle;

a power transmission mechanism compartment disposed rearward of a lower part of the engine compartment in the longitudinal direction;

a partition plate disposed above the power transmission mechanism compartment in the vertical direction and rearward of the engine compartment in the longitudinal direction; and a work area defined as a space surrounded by the engine compartment, the cooling device compartment, and the partition plate, a frontward side of the work area being defined by a rearward surface of the engine compartment, a lateral side of the work area being defined by vehicle-widthwise inwardly facing surface of the cooling device compartment, and a bottom of the work area being defined by the partition plate, each of the vertical direction, the longitudinal direction, and the lateral direction being perpendicular to one another.

14. The work vehicle according to claim 13, wherein the cooling device compartment is disposed on the one side of the engine compartment in the lateral direction.

15. The work vehicle according to claim 13, wherein the travel device includes a pair of crawler belts, and the cooling device compartment overlaps one of the crawler belts in a top plan view of the work vehicle.

* * * * *